US009480343B2

(12) United States Patent
Haut et al.

(10) Patent No.: US 9,480,343 B2
(45) Date of Patent: Nov. 1, 2016

(54) CHILD HIGH CHAIR

(71) Applicants: Robert E. Haut, Merion Station, PA (US); Andrew J. Taylor, Mohnton, PA (US); Anthony V. Ruggiero, Downingtown, PA (US); Curtis M. Hartenstine, Birdsboro, PA (US)

(72) Inventors: Robert E. Haut, Merion Station, PA (US); Andrew J. Taylor, Mohnton, PA (US); Anthony V. Ruggiero, Downingtown, PA (US); Curtis M. Hartenstine, Birdsboro, PA (US)

(73) Assignee: Wonderland Nurserygoods Company Limited, NT (HK)

( * ) Notice: Subject to any disclaimer, the term of this patent is extended or adjusted under 35 U.S.C. 154(b) by 0 days.

(21) Appl. No.: 14/298,974

(22) Filed: Jun. 9, 2014

(65) Prior Publication Data

US 2014/0368014 A1 Dec. 18, 2014

Related U.S. Application Data

(60) Provisional application No. 61/956,705, filed on Jun. 14, 2013, provisional application No. 61/957,824, filed on Jul. 12, 2013, provisional application No. 61/963,678, filed on Dec. 11, 2013.

(51) Int. Cl.
*A47D 1/00* (2006.01)

(52) U.S. Cl.
CPC ..... *A47D 1/004* (2013.01); *A47D 1/00* (2013.01); *A47D 1/008* (2013.01)

(58) Field of Classification Search
CPC ..... A47D 1/006
USPC ..... 297/256.16
See application file for complete search history.

(56) References Cited

U.S. PATENT DOCUMENTS

| | | | | |
|---|---|---|---|---|
| 5,028,061 | A | 7/1991 | Hawkes | |
| 5,364,137 | A | 11/1994 | Shimer | |
| 5,564,778 | A | 10/1996 | Shimer | |
| 5,951,102 | A | 9/1999 | Poulson | |
| 6,361,106 | B1 | 3/2002 | Huang | |
| 6,938,861 | B1 | 9/2005 | Ballard | |
| 7,401,803 | B1 | 7/2008 | Lai | |
| D618,001 | S | 6/2010 | Bearup | |
| 8,419,559 | B2 | 4/2013 | Zhang | |
| 8,845,028 | B2 | 9/2014 | Miller | |
| 2008/0179923 | A1 | 7/2008 | Lake | |
| 2009/0001776 | A1* | 1/2009 | Bearup | A47D 1/002 297/153 |

(Continued)

FOREIGN PATENT DOCUMENTS

| | | | |
|---|---|---|---|
| CN | 2686459 | Y | 3/2005 |
| CN | 2794336 | Y | 7/2006 |

(Continued)

*Primary Examiner* — Timothy J Brindley
(74) *Attorney, Agent, or Firm* — Winston Hsu; Scott Margo

(57) ABSTRACT

A child high chair includes a frame, a seat and a seat attaching mechanism. The seat is detachably assembled with the frame and includes a seat body. The seat attaching mechanism includes a first combining component, a second combining component and a latch. The first combining component is disposed on the frame, and a sunken portion is disposed inside the first combining component. The second combining component is disposed on the seat body to combine with the first combining component. An opening is formed on the second combining component. The latch is disposed inside the second combining component and pivots to the second combining component. The latch includes a protruding portion, which is adapted to protrude from the second combining component via the opening to detachably engage with the sunken portion.

17 Claims, 26 Drawing Sheets

(56) References Cited

U.S. PATENT DOCUMENTS

| | | | | |
|---|---|---|---|---|
| 2009/0045656 | A1 | 2/2009 | Chen | |
| 2009/0256323 | A1* | 10/2009 | Mostert | B60N 2/2848 280/47.38 |
| 2009/0315374 | A1* | 12/2009 | Hu | A47D 1/004 297/256.16 |
| 2010/0181806 | A1 | 7/2010 | Hu | |
| 2011/0074187 | A1* | 3/2011 | Zhong | A47D 1/006 297/130 |
| 2011/0291389 | A1 | 12/2011 | Offord | |
| 2012/0261961 | A1* | 10/2012 | Heisey | B60N 2/2827 297/256.16 |
| 2013/0076079 | A1 | 3/2013 | Wang | |
| 2013/0082455 | A1 | 4/2013 | Chen | |
| 2014/0054939 | A1* | 2/2014 | Hu | F16B 5/0642 297/256.16 |
| 2014/0061404 | A1* | 3/2014 | Xiao | A47D 1/006 248/154 |
| 2014/0292050 | A1* | 10/2014 | Chen | A47C 4/02 297/256.16 |
| 2014/0368006 | A1* | 12/2014 | Taylor | A47D 1/004 297/188.11 |
| 2014/0368009 | A1* | 12/2014 | Haut | A47D 1/006 297/256.13 |

FOREIGN PATENT DOCUMENTS

| | | | |
|---|---|---|---|
| CN | 201312666 | Y | 9/2009 |
| CN | 101606801 | A | 12/2009 |
| CN | 101669737 | A | 3/2010 |
| CN | 301274724 | S | 6/2010 |
| CN | 102462255 | A | 5/2012 |
| DE | 20 2007 005 977 | U1 | 9/2007 |
| DE | 10 2007 014 995 | A1 | 10/2008 |
| DE | 10 2009 034 552 | B3 | 2/2011 |
| EP | 0 228 158 | A2 | 7/1987 |
| GB | 2 449 999 | A | 12/2008 |
| WO | 2006130906 | A1 | 12/2006 |
| WO | 2007112883 | A2 | 10/2007 |
| WO | 2007112883 | A3 | 10/2007 |

* cited by examiner

CHILD HIGH CHAIR

CROSS REFERENCE TO RELATED APPLICATIONS

This application claims the benefit of U.S. provisional application No. 61/956,705 (which was filed on Jun. 14, 2013), U.S. provisional application No. 61/957,824 (which was filed on Jul. 12, 2013), and U.S. provisional application No. 61/963,678 (which was filed on Dec. 11, 2013). The entire contents of these related applications are incorporated herein by reference.

BACKGROUND OF THE INVENTION

1. Field of the Invention

The present invention relates to a child high chair, and more particularly, to a child high chair with a seat attaching mechanism and a height adjusting mechanism.

2. Description of the Prior Art

A conventional child high chair is suitable for children about six-year-old. A seat height of the child high chair can be adjusted to be close to the caregiver in order to conveniently attend to the child. The conventional child high chair includes rollers disposed on a frame to easily move the child high chair. The conventional child high chair further includes a tray disposed on the seat, and the tray can be utilized to put the food, the toy and so on. However, the seat of the conventional child high chair cannot detach from the frame, an angle formed between the seat and the frame is predetermined, and the seat cannot be inclined according to child's age. Therefore, design of a child high chair capable of adjusting an inclined angle and height position of the detachable seat is an important issue in the related mechanical design industry.

SUMMARY OF THE INVENTION

The present invention provides a child high chair with a seat attaching mechanism and a height adjusting mechanism for solving above drawbacks.

According to the claimed invention, a child high chair which includes a frame, a seat and a seat attaching mechanism is disclosed. The seat is detachably assembled with the frame and includes a seat body. The seat attaching mechanism is disposed between the frame and the seat. The seat attaching mechanism includes a first combining component, a second combining component and a latch. The first combining component is disposed on the frame, and a sunken portion is disposed inside the first combining component. The second combining component is disposed on the seat body and is adapted to combine with the first combining component. An opening is formed on the second combining component. The latch is disposed inside the second combining component. An end of the latch pivots to the second combining component in a resilient recovery manner. The latch includes a protruding portion, which is adapted to protrude from the second combining component via the opening to detachably engage with the sunken portion.

According to the claimed invention, the seat attaching mechanism further includes a releasing component movably disposed on the seat body and connected to the latch. The releasing component rotates the latch relative to the second combining component to retract the protruding portion into the opening since the releasing component is pressed relative to the seat body. The latch further includes a stretching portion disposed on the other end of the latch. The releasing component has a first side and a second side opposite to each other. The first side pivots to the seat body, and the second side is connected to the stretching portion of the latch.

According to the claimed invention, the first combining component includes a first engaging portion adjacent to a lower side of the sunken portion, and a second engaging portion is disposed on a bottom of the second combining component. The second engaging portion is engaged with the first engaging portion since the second combining component is combined with the first combining component. The first engaging portion and the second engaging portion respectively are a rib and a slot, and a length of the slot is greater than a length of the rib.

According to the claimed invention, an upper wall of the first combining component contacts against a wall of the seat body. The latch further includes a guiding structure disposed on the protruding portion. The guiding structure slidably contacts the first combining component to move the protruding portion into the opening. The seat attaching mechanism further includes a flexible component. Two ends of the flexible component are respectively connected to the latch and the second combining component.

According to the claimed invention, the seat attaching mechanism further includes an actuating component movably disposed on the second combining component. The latch further includes an inclined protrusion adjacent to the protruding portion. The actuating component slidably contacts the inclined protrusion to disengage the protruding portion from the sunken portion. A part of the actuating component is exposed via a control hole formed on the second combining component. The seat attaching mechanism further includes a resilient component. Two ends of the resilient component are respectively connected to the actuating component and the second combining component.

According to the claimed invention, a first wedging portion is disposed on the end of the latch, and a second wedging portion is disposed on a bottom of the second combining component. The first wedging portion is engaged with the second wedging portion since the latch pivots to the second combining component. The first wedging portion and the second wedging portion respectively are a slot and a rib, and a length of the slot is greater than a length of the rib.

According to the claimed invention, the frame further includes a low supporter and an upper supporter slidably disposed on the low supporter. The child high chair further includes a height adjusting mechanism disposed on the frame. The height adjusting mechanism includes a base, at least one hook, a triggering component and at least one cable. The hook is rotatably disposed inside the upper supporter and is adapted to simultaneously insert into piercing holes formed on the upper supporter and the low supporter. The triggering component is movably disposed on the base. Two ends of the cable are respectively connected to the hook and the triggering component, and the triggering component moves relative to the base to rotate the hook via the cable.

According to the claimed invention, the height adjusting mechanism further includes at least one pulling component rotatably disposed on the base. A first rod of the pulling component is connected to the cable and movably contacts against the triggering component. A second rod of the pulling component slidably contacts the cable. An angle is formed between the first rod and the second rod. The height adjusting mechanism further includes two hooks, two cables and two pulling components. Each pulling component is connected to the corresponding hook via the corresponding cable, and the pulling components movably contact against the triggering component.

According to the claimed invention, the height adjusting mechanism further includes an elastic component. Elastic recovering force of the elastic component drives the hook to insert into the piercing holes of the upper supporter and the low supporter. The height adjusting mechanism further includes a holding component slidably disposed inside the upper supporter. A pin of the hook slidably inserts into a chute of the holding component, and the elastic component is connected between the holding component and the upper supporter.

According to the claimed invention, the first combining component further includes a retaining portion disposed on an inner surface of the first combining component, a retaining slot is formed on the second combining component, and the first combining component is engaged with the second combining component by assembly of the retaining portion and the retaining slot. A finger of the latch slidably contacts the retaining portion, the finger contacts against a surface of the retaining portion to constrain relative movement between the latch and the second combining component and the latch is located inside the opening.

The present invention provides the child high chair with detached assembly of the frame and the seat. The seat can be the toddler seat or the infant seat. The toddler seat can be assembled with the frame or disassembled from the frame for being the standalone toddler chair. The infant seat can be assembled with the frame or disassembled from the frame for being the standalone infant rocker. The height position of the seat is adjusted relative to the frame by the height adjusting mechanism, which has advantages of simple structure and easy one-hand operation. The seat attaching mechanism utilizes the latch to detachably engage with the sunken portion for assembly of the combining components, which are respectively disposed on the frame and the seat, and gives consideration to stable assembly strength and preferred operational efficiency.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
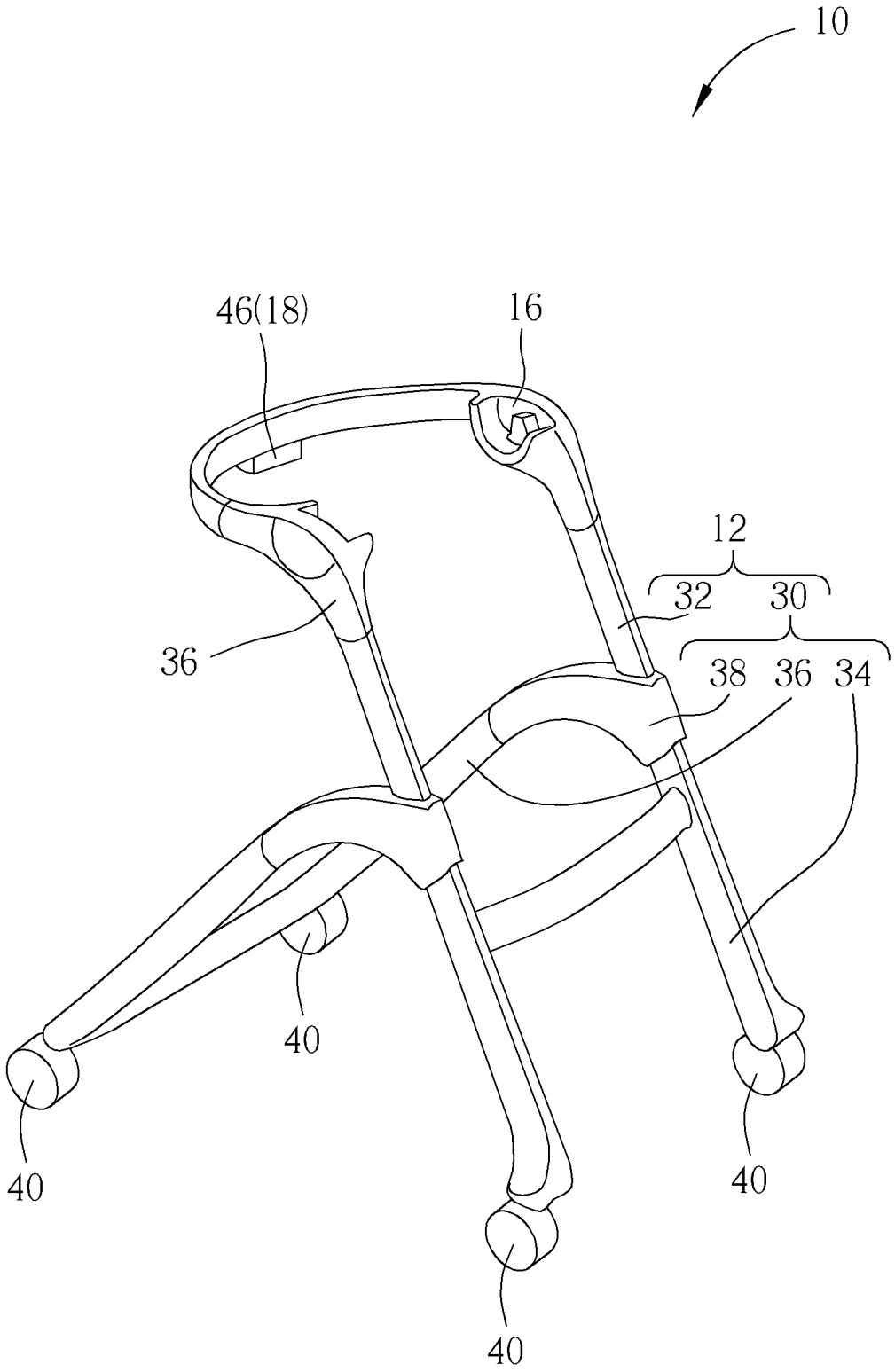
FIG. 1 to FIG. 3 respectively are diagrams of a child high chair in different modes according to an embodiment of the present invention.
Figure 2:
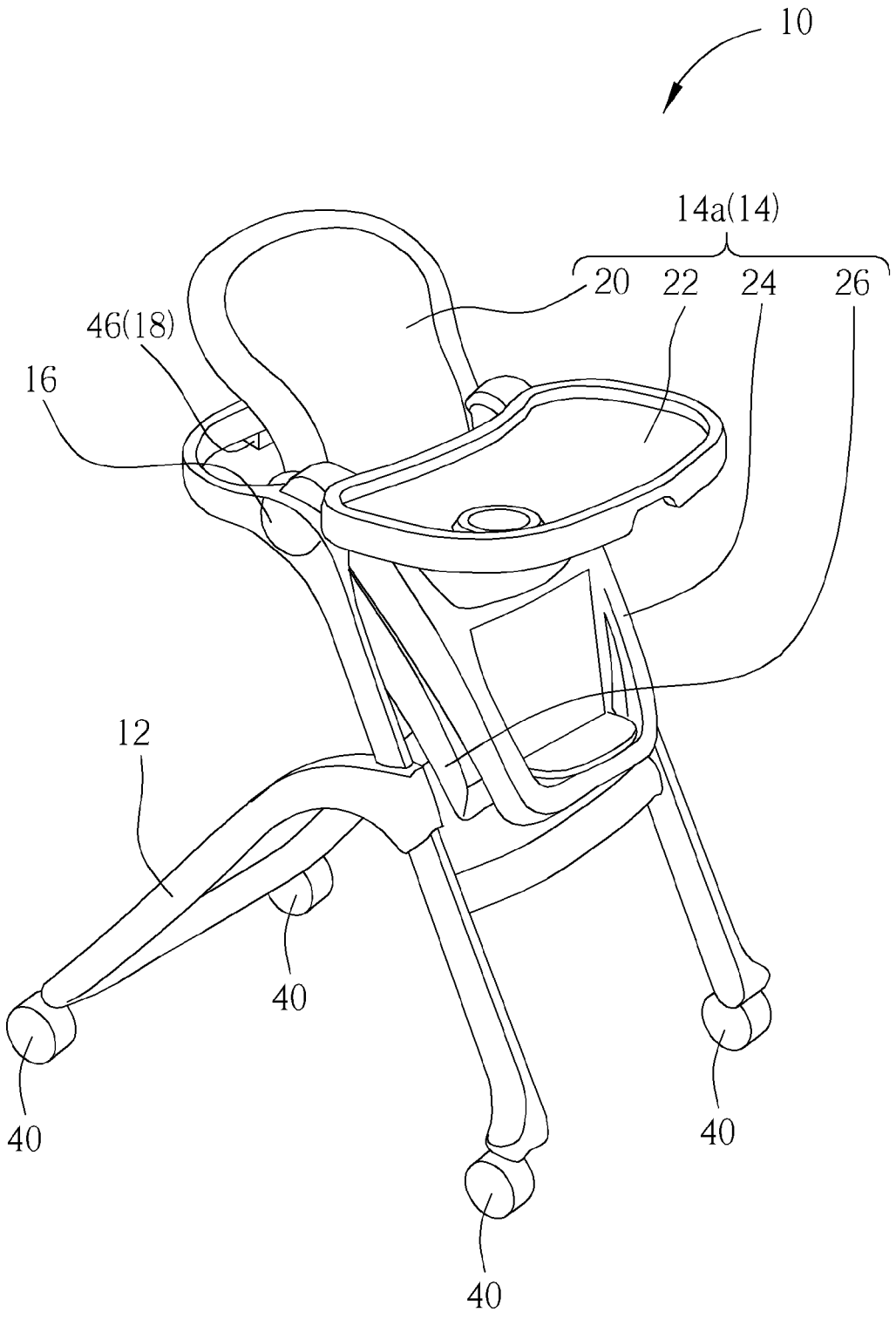
Figure 3:
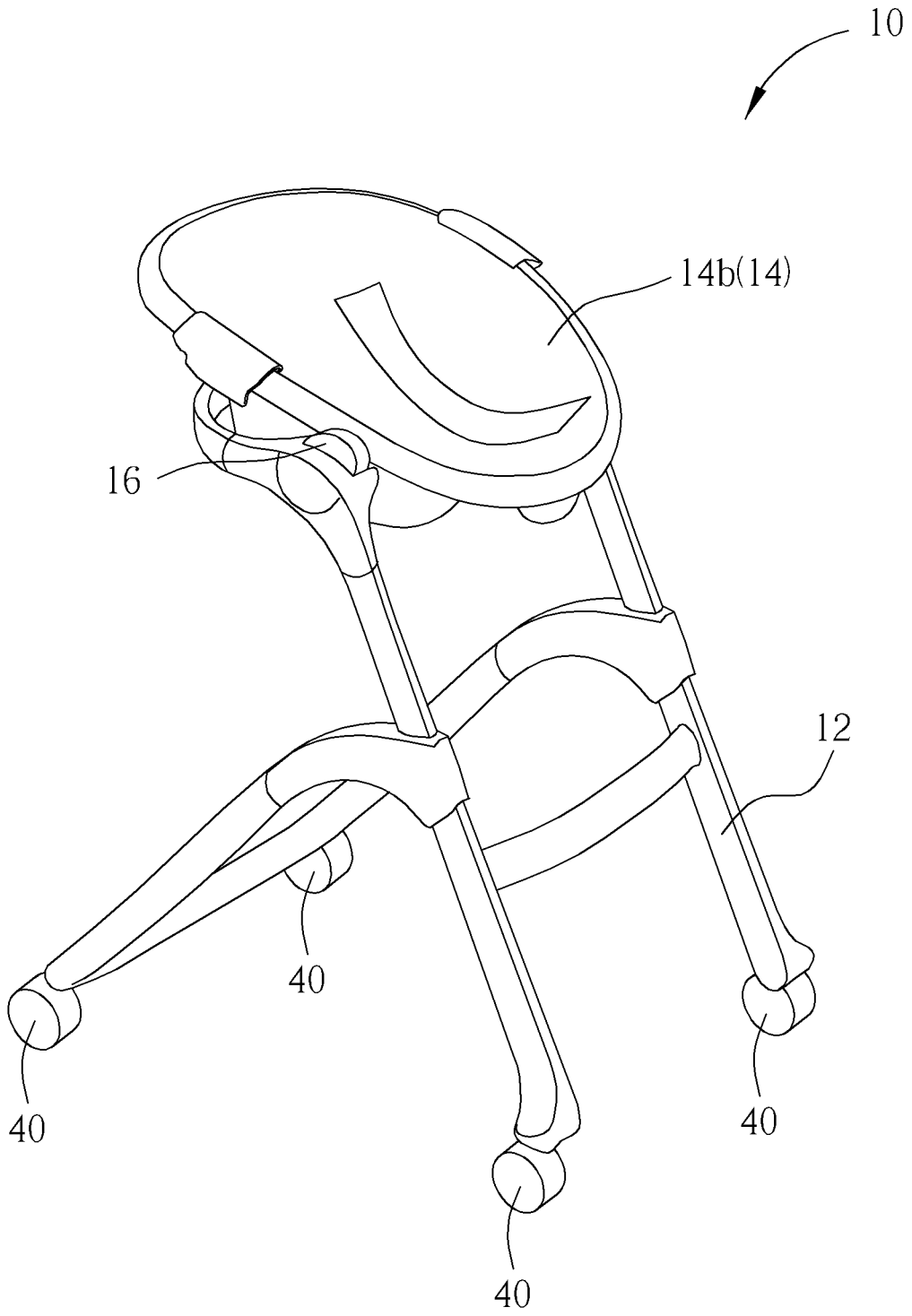

Please refer to FIG. 1 to FIG. 3. FIG. 1 to FIG. 3 respectively are diagrams of a child high chair 10 in different modes according to an embodiment of the present invention. The child high chair 10 includes a frame 12, a seat 14, a seat attaching mechanism 16 and a height adjusting mechanism 18. The seat attaching mechanism 16 is disposed between the frame 12 and the seat 14 for easy assembly and disassembly. The height adjusting mechanism 18 is disposed on the frame 12 to adjust height position of the seat 14. FIG. 1 shows the child high chair 10 without the seat. The height adjusting mechanism 18 is mostly disposed inside the frame 12 and cannot be watched except a triggering component 46, and part of the seat attaching mechanism 16 is shown on an upper edge of the frame 12.

Figure 4:
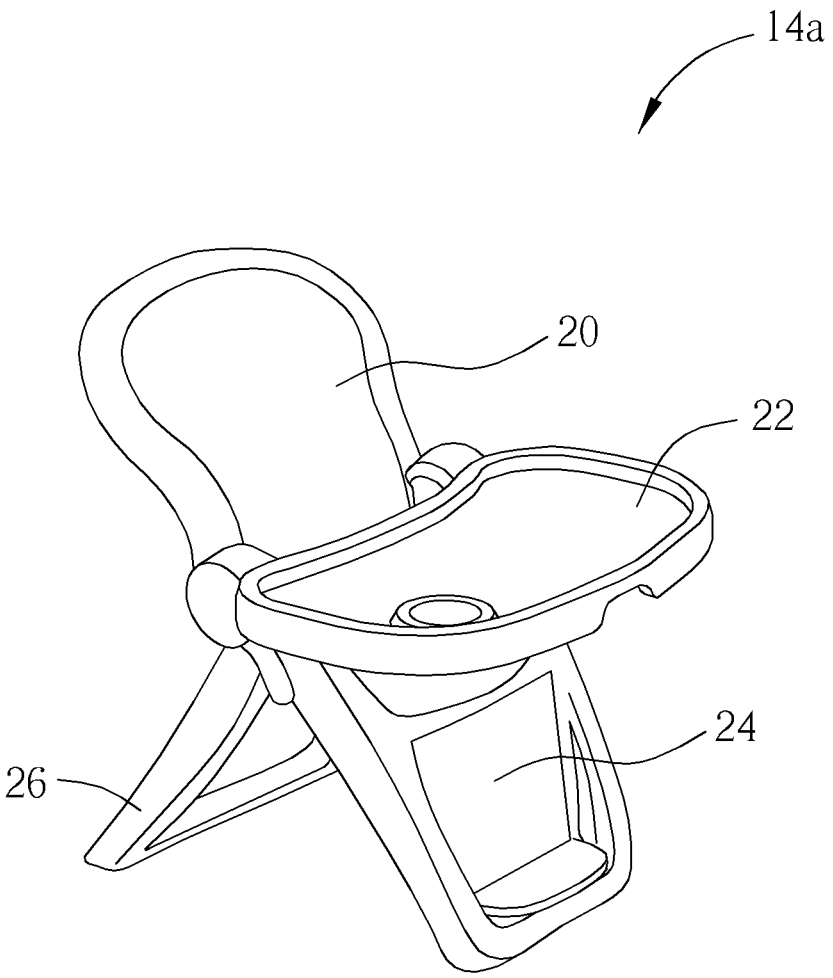
FIG. 4 is a diagram of a toddler seat in another mode according to the embodiment of the present invention.

The seat 14 which can be a toddler seat 14*a* (such as shown in FIG. 2) or an infant seat 14*b* (such as shown in FIG. 3) is detachably assembled with the frame 12. Please refer to FIG. 2 and FIG. 4. FIG. 4 is a diagram of the toddler seat 14*a* in another mode according to the embodiment of the present invention. The toddler seat 14*a* includes a seat body 20, a tray 22, a first foot 24 and a second foot 26. The tray 22 is detachably disposed on the seat body 20 to hold the food or the toy. The first foot 24 is fixed to the seat body 20, and the second foot 26 is pivotably connected to the seat body 20. As shown in FIG. 2, the second foot 26 pivots to a first position to be substantially parallel to the first foot 24, and the toddler seat 14*a* can be assembled with the frame 12 to form the child high chair 10. As shown in FIG. 4, the second foot 26 pivots to a second position to be distant from the first foot 24. An angle is formed between the first foot 24 and the second foot 26. The toddler seat 14*a* can be used as a standalone toddler chair by support of the first foot 24 and the second foot 26.

Figure 5:
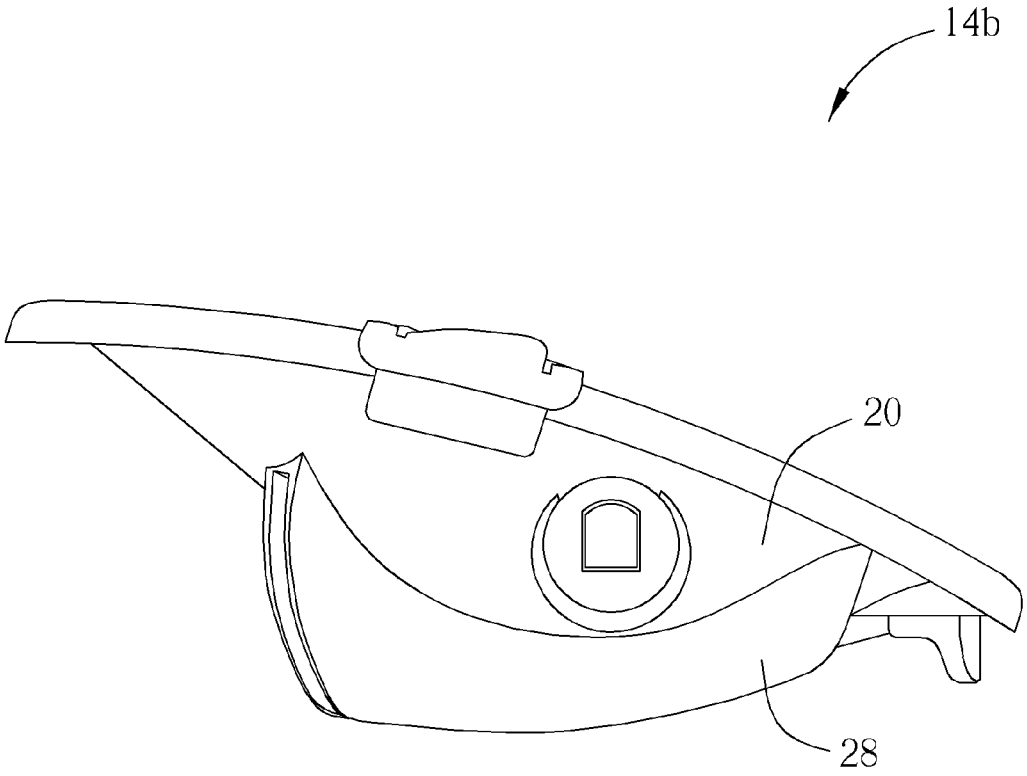
FIG. 5 is a diagram of an infant seat according to the embodiment of the present invention.

Please refer to FIG. 3 and FIG. 5 . FIG. 5 is a diagram of the infant seat 14*b* according to the embodiment of the present invention. The infant seat 14*b* includes the seat body 20 and an arc pedestal 28 (without the tray and the feet). The arc pedestal 28 is disposed on a bottom of the seat body 20. The infant seat 14*b* put on a supporting plane (such as the table or the ground) can slightly waver by the arc pedestal 28 to comfort the infant, and the infant seat 14*b* is used as a standalone infant rocker.

As shown in FIG. 1, the frame 12 includes a low supporter 30 and an upper supporter 32. The seat 14 is disposed on the upper supporter 32, and the upper supporter 32 is slidably disposed on the low supporter 30 so as to adjust the height position of the seat 14. The low supporter 30 includes two legs 34, 36 and abridging component 38. A roller 40 may be connected to a low end of the legs 34, 36. An amount of the roller 40 is one or more, which corresponds to an amount of the legs 34, 36. Further, upper ends of the legs 34, 36 are connected to each other via the bridging component 38. The upper supporter 32 is slidably disposed on the leg 34 of the low supporter 30 through the bridging component 38, and the height position of the seat 14 can be adjusted by move in or move out the upper supporter 32 from the low supporter 30.

Figure 6:
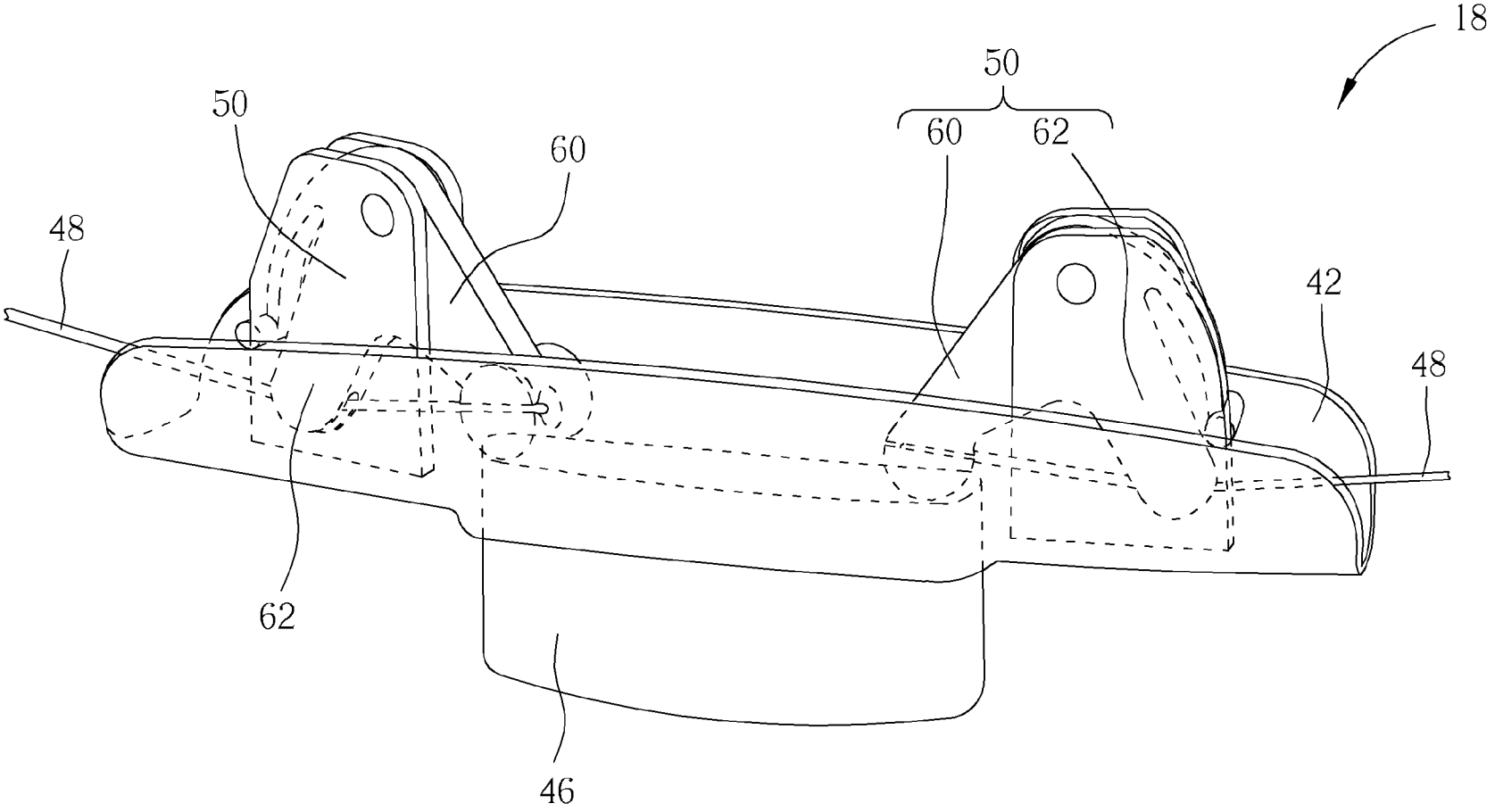
FIG. 6 and FIG. 7 respectively are diagrams of different parts of a height adjusting mechanism in a locked mode according to the embodiment of the present invention.
Figure 7:
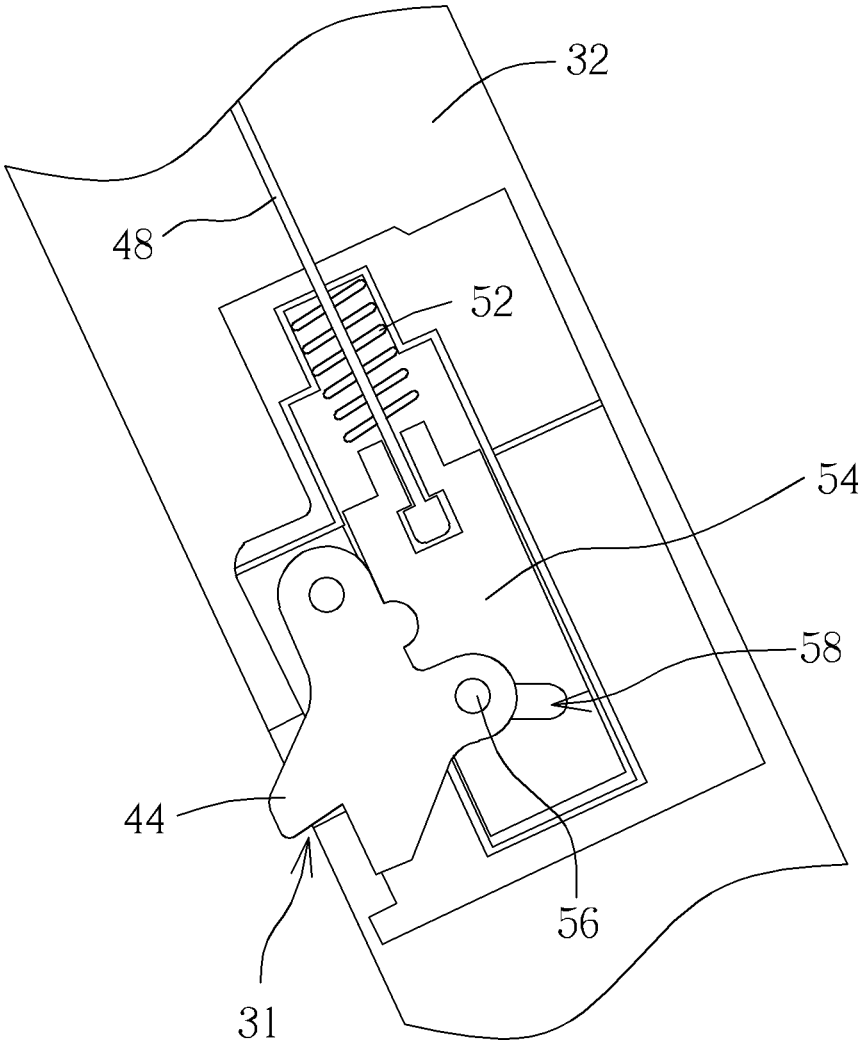
Figure 8:
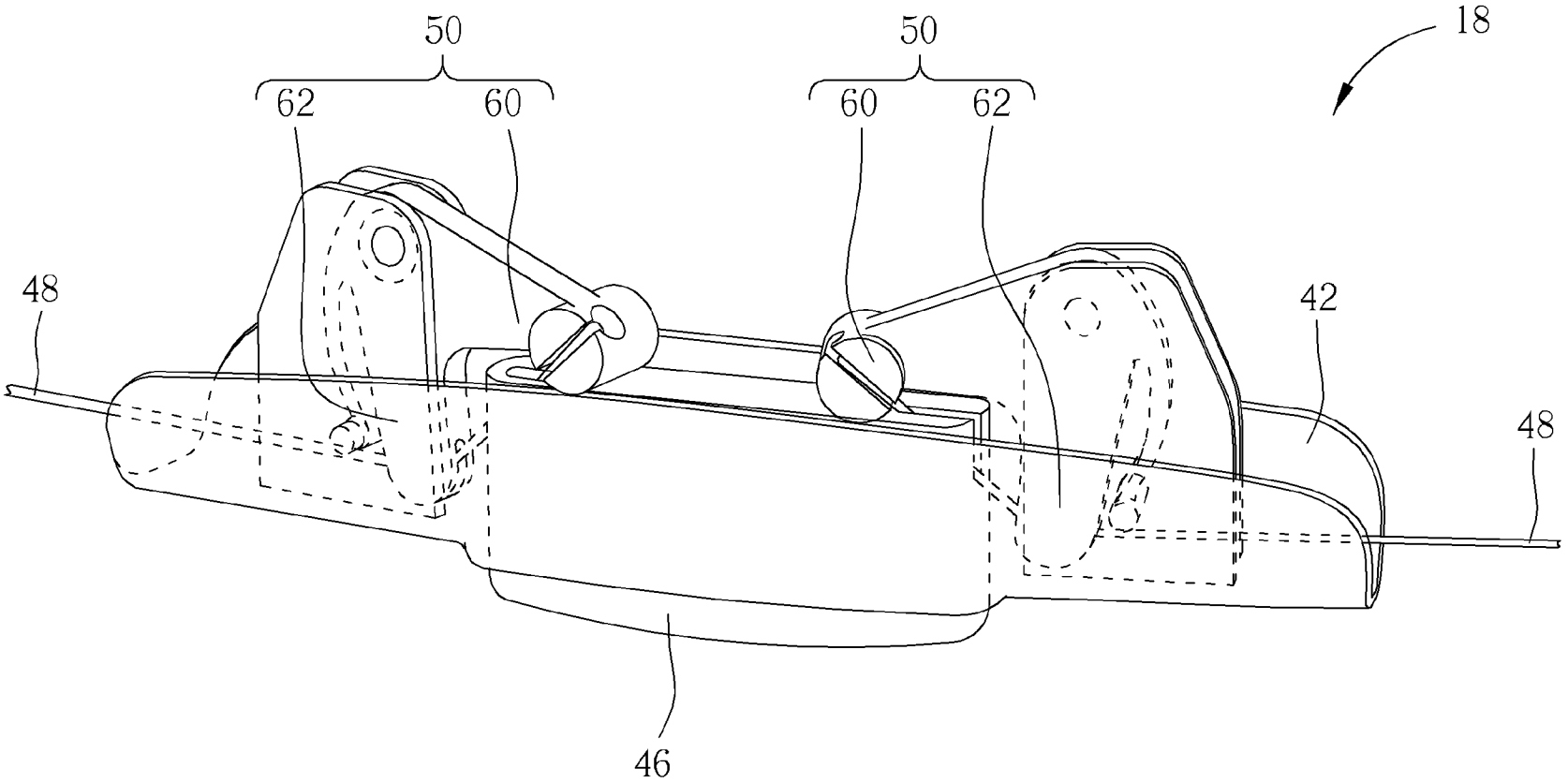
FIG. 8 and FIG. 9 respectively are diagrams of different parts of the height adjusting mechanism in an unlocked mode according to the embodiment of the present invention.
Figure 9:
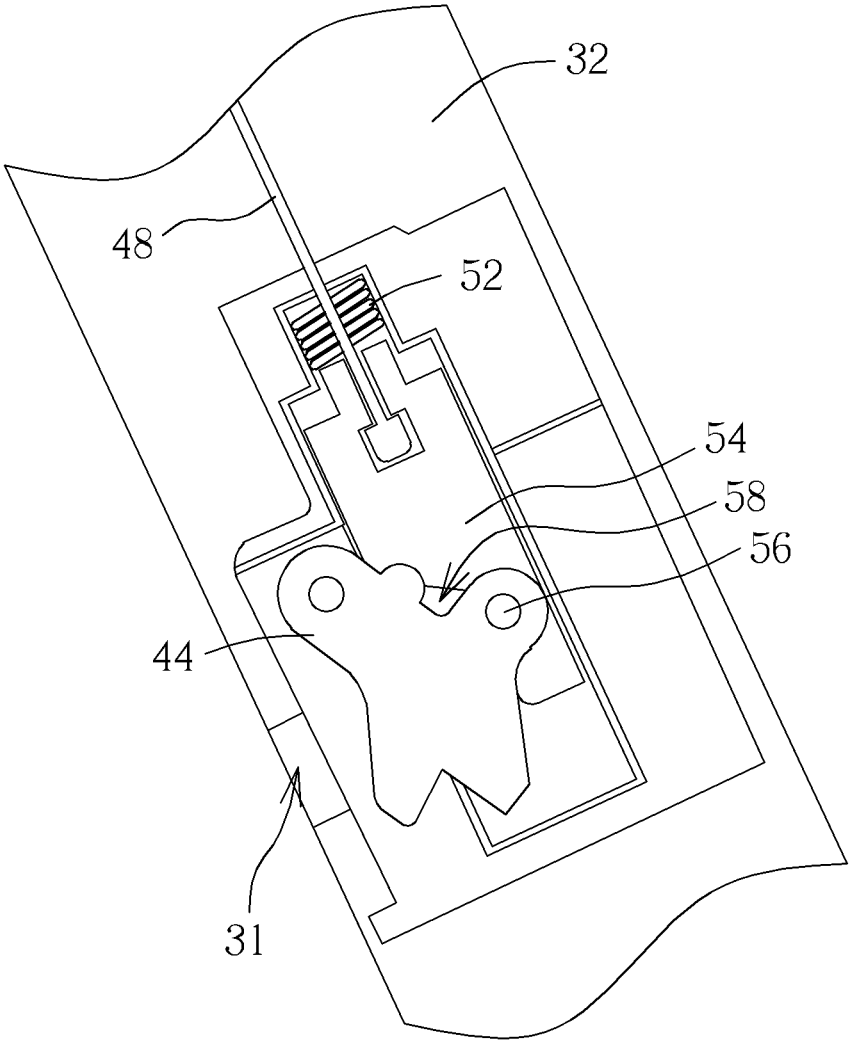

Please refer to FIG. 6 to FIG. 9. FIG. 6 and FIG. 7 respectively are diagrams of different parts of the height adjusting mechanism 18 in a locked mode according to the embodiment of the present invention. FIG. 8 and FIG. 9 respectively are diagrams of different parts of the height adjusting mechanism 18 in an unlocked mode according to the embodiment of the present invention. The height adjusting mechanism 18 includes a base 42, at least one hook 44, a triggering component 46, at least one cable 48, at least one pulling component 50, an elastic component 52 and a holding component 54. The base 42 may be a part of the upper supporter 32 which is not sheltered by the low supporter 30, and the triggering component 46 is movably disposed on the base 42. Position of the triggering component 46 is not limited to an upper section of the upper supporter 32, as shown in FIG. 1, and the triggering component 46 further can be selectively disposed on a lateral section of the upper supporter 32, which depends on design's demand.

The hook 44, the cable 48, the pulling component 50, the elastic component 52 and the holding component 54 are hidden inside the frame 12. The holding component 54 is slidably disposed inside another part of the upper supporter 32 overlapping the low supporter 30. The hook 44 is rotatably disposed inside the upper supporter 32 and a pin 56 of the hook 44 slidably inserts into a chute 58 of the holding component 54. The pulling component 50 is rotatably disposed on the base 42. The pulling component 50 includes a first rod 60 and a second rod 62 where an angle is formed between. The first rod 60 is connected to the cable 48 and movably contacts against the triggering component 46, and the second rod 62 slidably contacts middle of the cable 48. Two ends of the cable 48 are respectively connected to the hook 44 via the holding component 54 and to the triggering component 46 via the pulling component 50. The elastic component 52 is formed between the holding component 54 and the upper supporter 32.

As shown in FIG. 6 and FIG. 7, elastic recovering force of the elastic component 52 drives the hook 44 to simultaneously insert into piercing holes 31 formed on the upper supporter 32 and the low supporter 30, so as to constrain relative movement of the supporters 30, 32 and height adjustment of the frame 12. As shown in FIG. 8 and FIG. 9, the triggering component 46 is pressed (by an external force of user) to move relative to the base 42, and the pulling component 50 is rotated by the triggering component 46, which applies pressure to the first rod 60. The first rod 60 and the second rod 62 respectively pulls and pushes the cable 48, the holding component 54 is moved by the cable 48 to rotate the hook 44 via assembly of the pin 56 and the chute 58, the hook 44 is retracted into the upper supporter 32 through the piercing holes 31, and the upper supporter 32 can freely slide relative to the low supporter 30 to adjust the height position of the seat 14. Since the external force is removed from the triggering component 46, the elastic component 52 moves the hook 44 to simultaneously insert into the piercing holes 31 on the supporters 30, 32 (such as position shown in FIG. 6 and FIG. 7), so as to constrain relative slide between the supporters 30, 32 and the height adjustment of the frame 12.

It should be mentioned that the height adjusting mechanism 18 preferably includes two hooks 44, two cables 48, two pulling components 50 and two holding components 54. The hooks 44 are respectively disposed on different legs of the upper supporter 32 to insert into the piercing holes 31 on the corresponding legs of the supporters 30, 32. Each pulling component 50 is connected to the corresponding hook 44 via the corresponding cable 48 and the corresponding holding component 54, and the pulling components 50 movably contact against opposite edges of the triggering component 46. The two hooks 44 can be simultaneously actuated to retract into the upper supporter 32 by one-hand control of the triggering component 46. Therefore, the height adjusting mechanism 18 of the present invention provides convenient operation.

Figure 10:
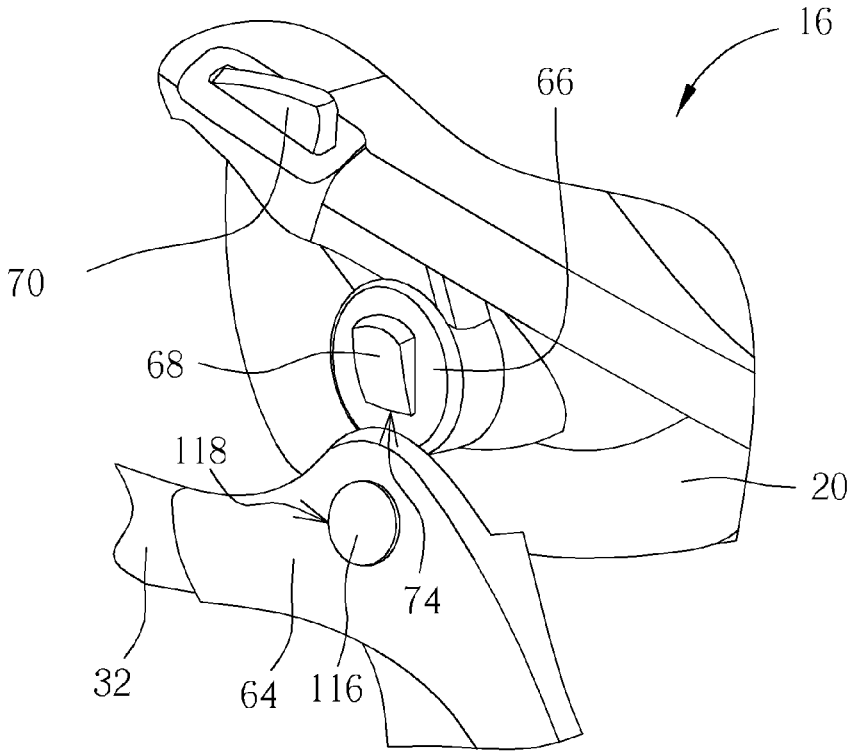
FIG. 10 is a partial disassembly diagram of the seat attaching mechanism according to a first embodiment of the present invention.
Figure 11:
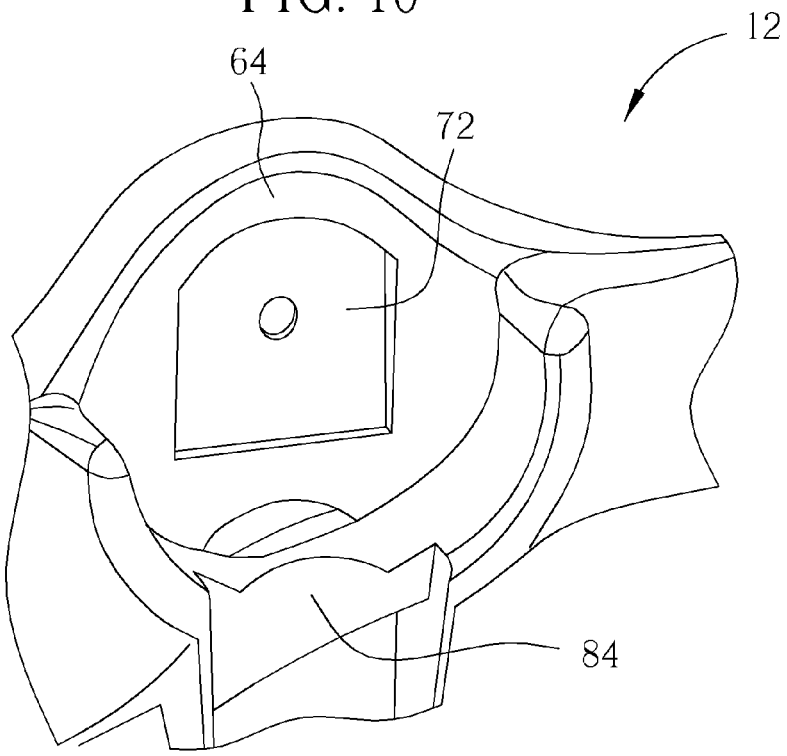
FIG. 11 is a partial diagram of a frame according to the first embodiment of the present invention.
Figure 13:
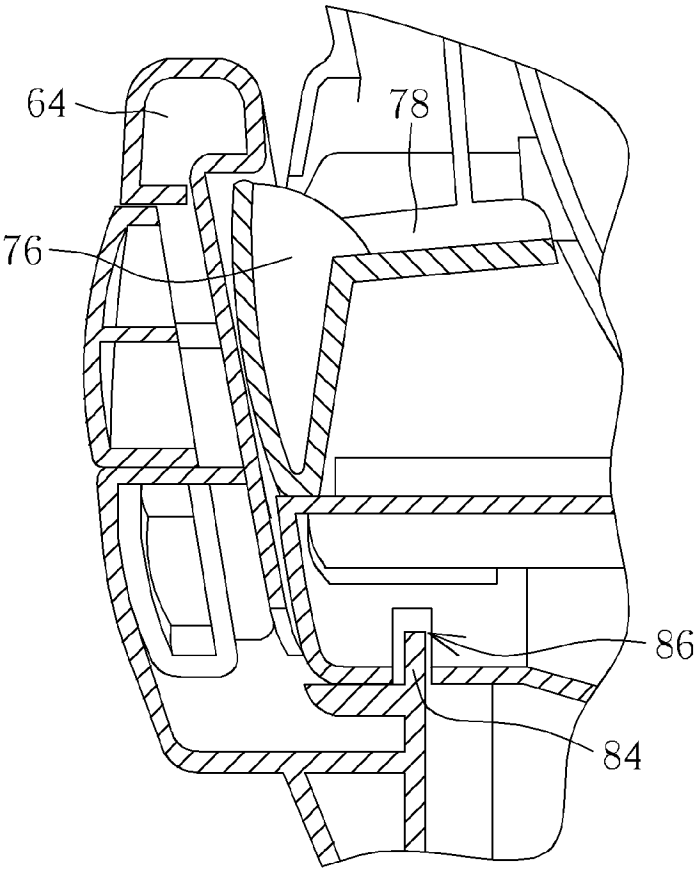
FIG. 12 and FIG. 13 respectively are sectional views of a seat attaching mechanism in different modes according to the first embodiment of the present invention.
Figure 12:
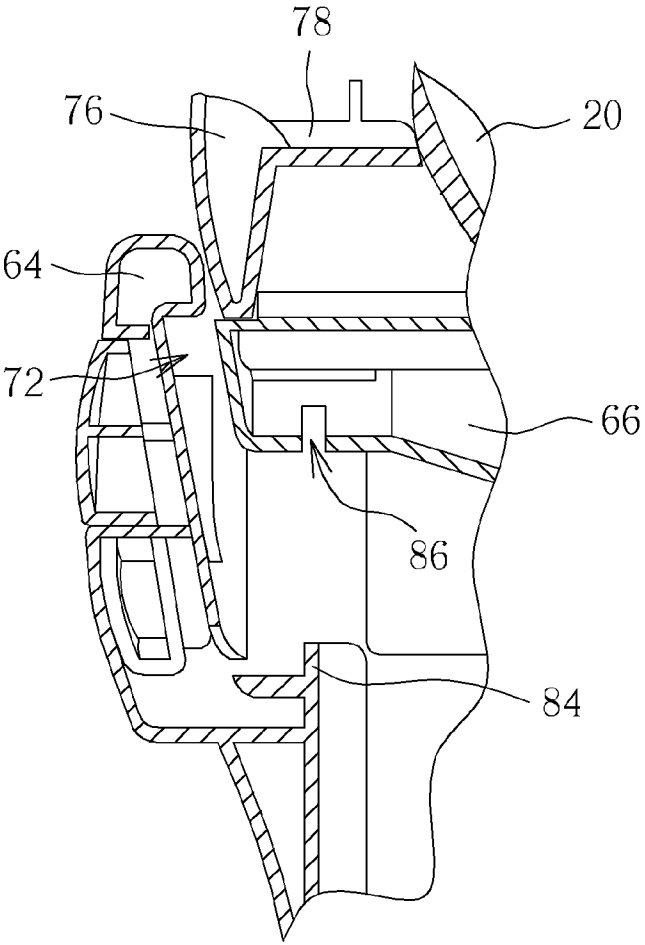
Figure 14:
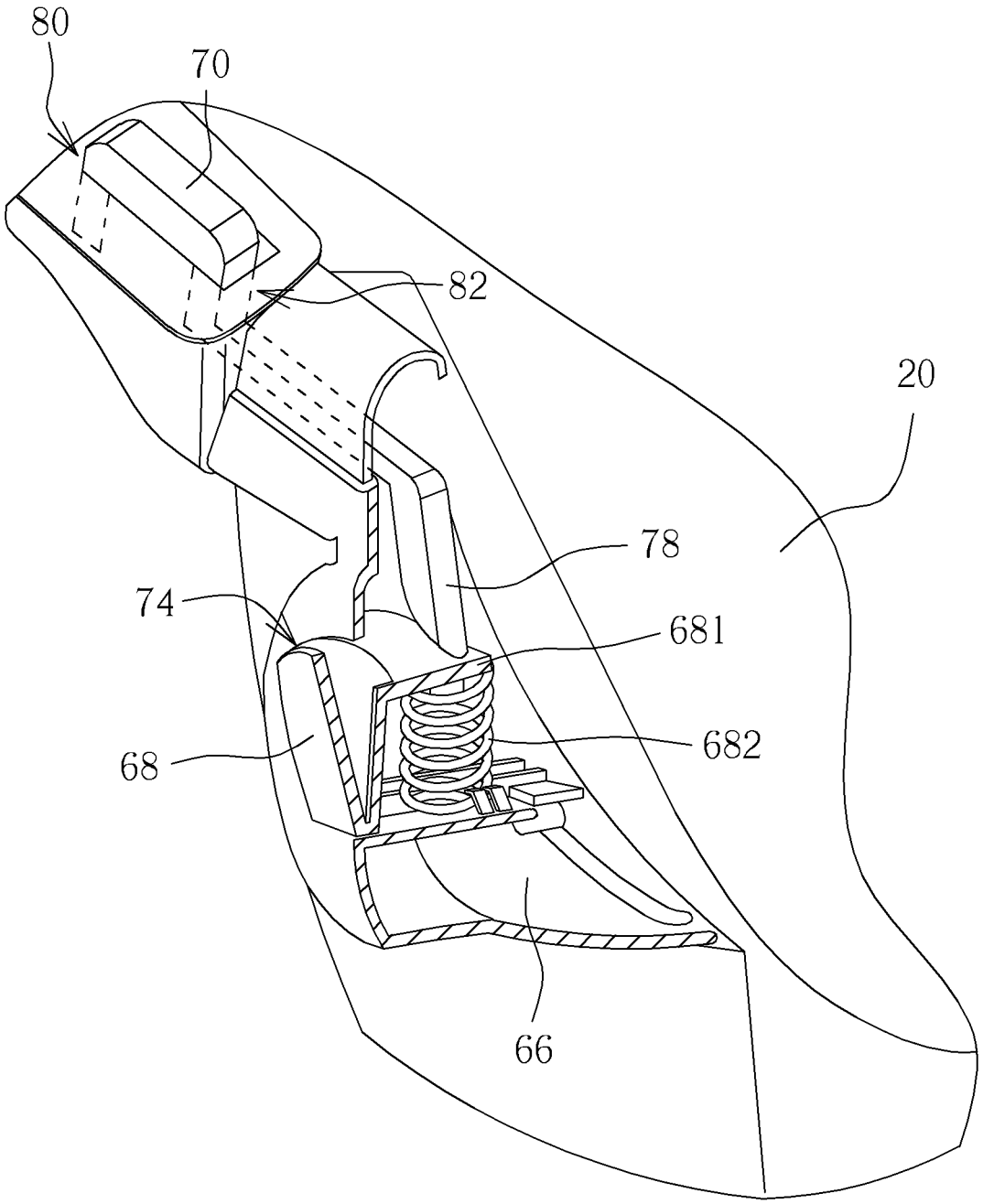
FIG. 14 and FIG. 15 respectively are sectional view of the seat attaching mechanism in different modes according to the first embodiment of the present invention.
Figure 15:
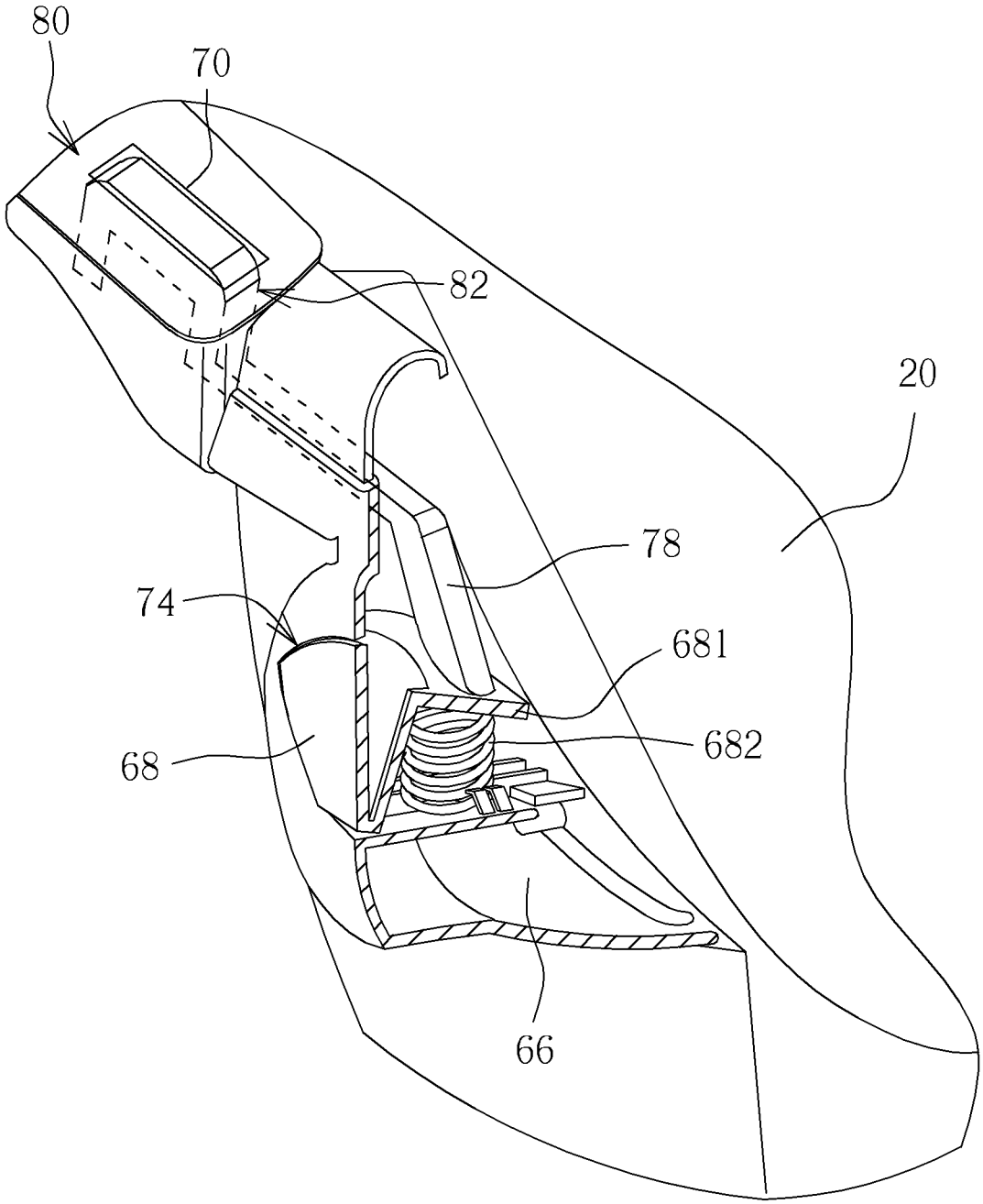

Please refer to FIG. 10 to FIG. 15. FIG. 10 is a partial disassembly diagram of the seat attaching mechanism 16 according to a first embodiment of the present invention. FIG. 11 is a partial diagram of the frame 12 according to the first embodiment of the present invention. FIG. 12 and FIG. 13 respectively are sectional views of the seat attaching mechanism 16 in different modes according to the first embodiment of the present invention. FIG. 14 and FIG. 15 respectively are sectional views of the seat attaching mechanism 16 in different modes according to the first embodiment of the present invention. The seat 14 of the first embodiment can be the infant seat 14*b* or the toddler seat 14*a*, and depends on actual demand.

The seat attaching mechanism 16 includes a first combining component 64, a second combining component 66, a latch 68 and a releasing component 70. The first combining component 64 is disposed on the upper supporter 32, and a sunken portion 72 is disposed inside the first combining component 64. The second combining component 66 is disposed on the seat body 20, and an opening 74 is formed on the second combining component 66. The latch 68 is disposed inside the second combining component 66 in a resilient recovery manner and an end of the latch 68 pivots to the second combining component 66. As the second combining component 66 is combined with the first combining component 64, a protruding portion 76 of the latch 68 can protrude from the second combining component 66 via the opening 74 to detachably engage with the sunken portion 72, and relative movement of the first combining component 64 and the second combining component 66 is constrained, as shown in FIG. 12 and FIG. 13.

A stretching portion 78 stretches from the releasing component 70 to movably contact against the latch 68. The releasing component 70 has a first side 80 and a second side 82 opposite to each other. The first side 80 pivots to the seat body 20, which means the releasing component 70 is movably disposed on the seat body 20, and the stretching portion 78 stretches from the second side 82 to slide relative to an inner portion 681 of the latch 68. As shown in FIG. 14, the stretching portion 78 contacts against a right side of the inner portion 681, and a part (such as the protruding portion 76) of the latch 68 protrudes from the opening 74. As shown in FIG. 15, the releasing component 70 is pressed to slide the stretching portion 78 from the foresaid right side to a left side of the inner portion 681, a first compressive spring 682 disposed between the latch 68 and the second combining component 66 is compressed, and the protruding portion 76 of the latch 68 can be retracted into the opening 74. Further, a resilient recovering force of the first compressive spring 682 can drive the latch 68 to partly protrude from the opening 74 when an external force applied to the releasing component 70 is removed. Therefore, the releasing component 70 can rotate the latch 68 relative to the second combining component 66 by relative slide between the stretching portion 78 and the inner portion 681 since the releasing component 70 is pressed relative to the seat body 20, so as to retract the protruding portion 76 into the opening 74, and the second combining component 66 can be separated from the first combining component 64 to detach the seat 14 from the frame 12.

In addition, the first combining component 64 includes a first engaging portion 84 adjacent to a lower side of the sunken portion 72, a second engaging portion 86 is disposed on a bottom of the second combining component 66. The second engaging portion 86 is engaged with the first engaging portion 84 since the second combining component 66 is combined with the first combining component 64, to laterally secure the seat 14 on the frame 12. The first engaging portion 84 and the second engaging portion 86 respectively are a rib and a slot, and a length of the slot is greater than a length of the rib. The second combining component 66 can slightly slide relative to the first combining component 64 by movable assembly of the first engaging portion 84 and the second engaging portion 86 in order to adjust an inclined angle of the seat 14.

Figure 16:
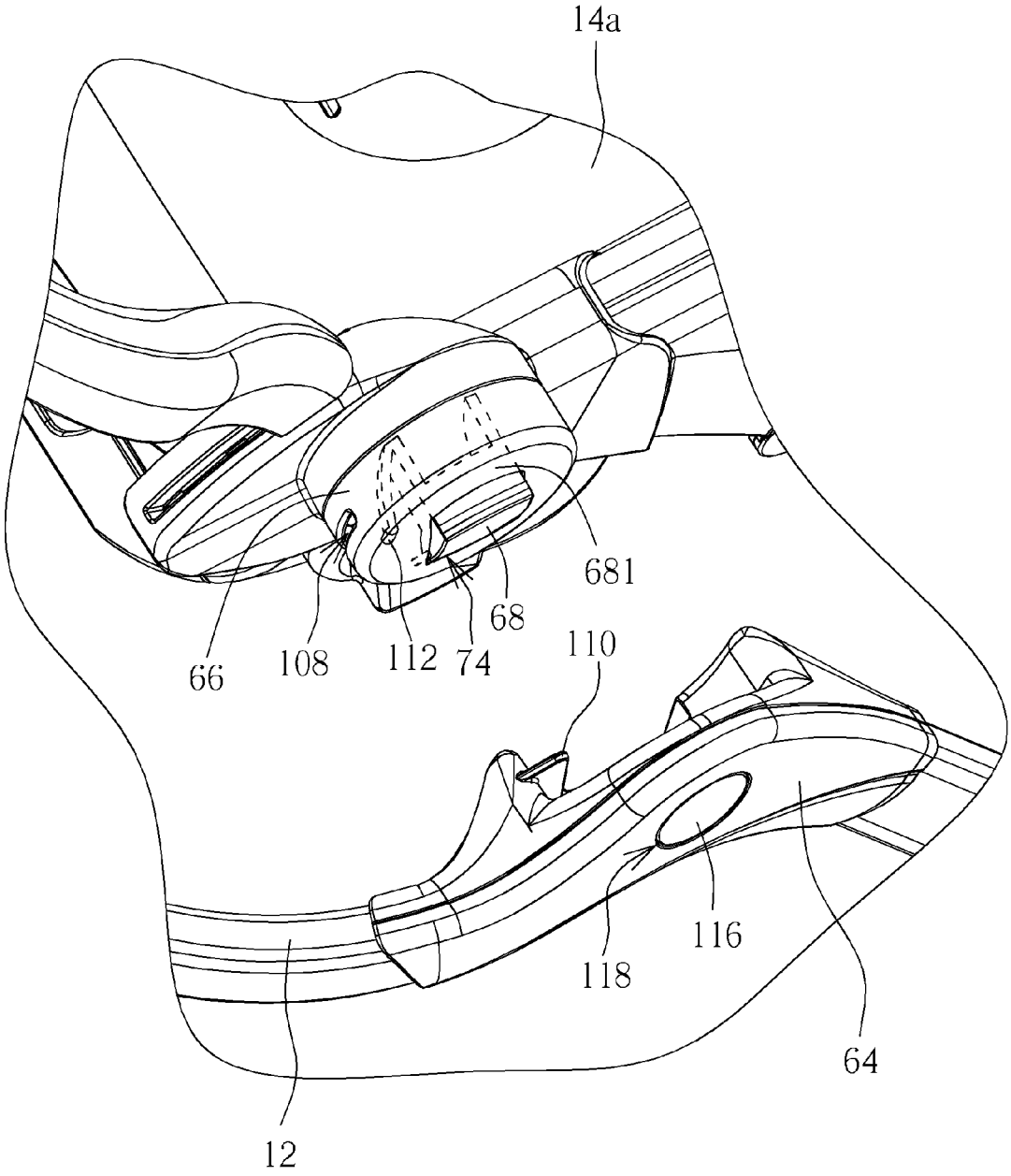
FIG. 16 is a diagram of the toddler seat and the frame in another view according to the first embodiment of the present invention.
Figure 17:
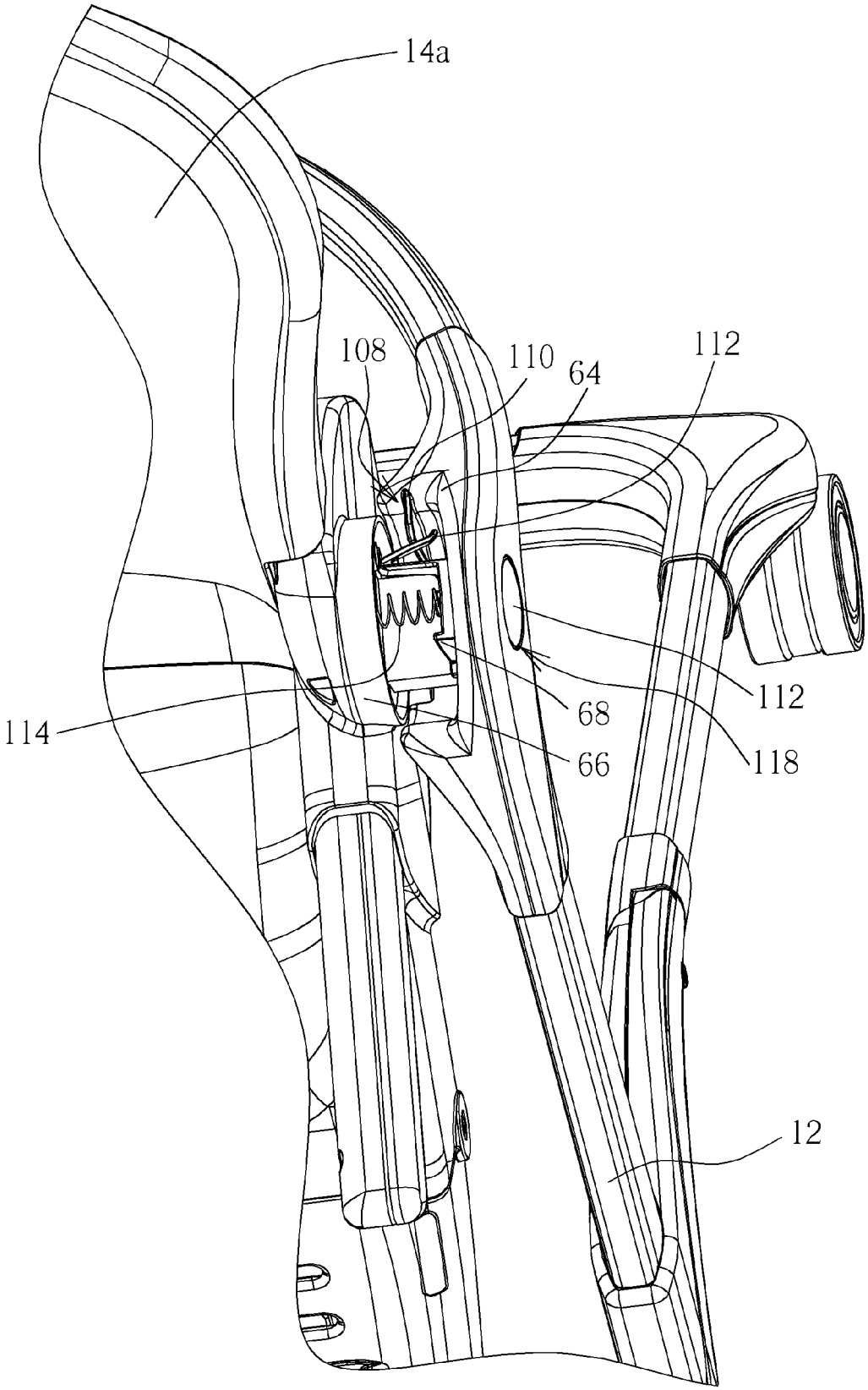
FIG. 17 is an assembly diagram of the toddler seat and the frame according to the first embodiment of the present invention.

Please refer to FIG. 16 and FIG. 17. FIG. 16 is a diagram of the toddler seat 14*a* and the frame 12 in another view according to the first embodiment of the present invention. FIG. 17 is an assembly diagram of the toddler seat 14*a* and the frame 12 according to the first embodiment of the present invention. A retaining slot 108 is formed on a lateral wall of the second combining component 66 to sheath on a retaining portion 110 of the first combining component 64, and a relative movement between the first combining component 64 and second combining component 66 can be retained. The retaining portion 110 is disposed on an inner surface of the first combining component 64. The latch 68 further includes a finger 112. An end of the finger 112 is flexible fixed to the inner portion 681 of the latch 68, and the other end of the finger 112 is a free end to slide relative or to contact against the retaining portion 110. As shown in FIG. 17, a second compressive spring 114 is disposed between the second combining component 66 and the latch 68. A resilient recovering force of the second compressive spring 114 drives the latch 68 to partly protrude from the opening 74. A deforming direction of the first compressive spring 682 may be different from a deforming direction of the second compressive spring 114.

Figure 18:
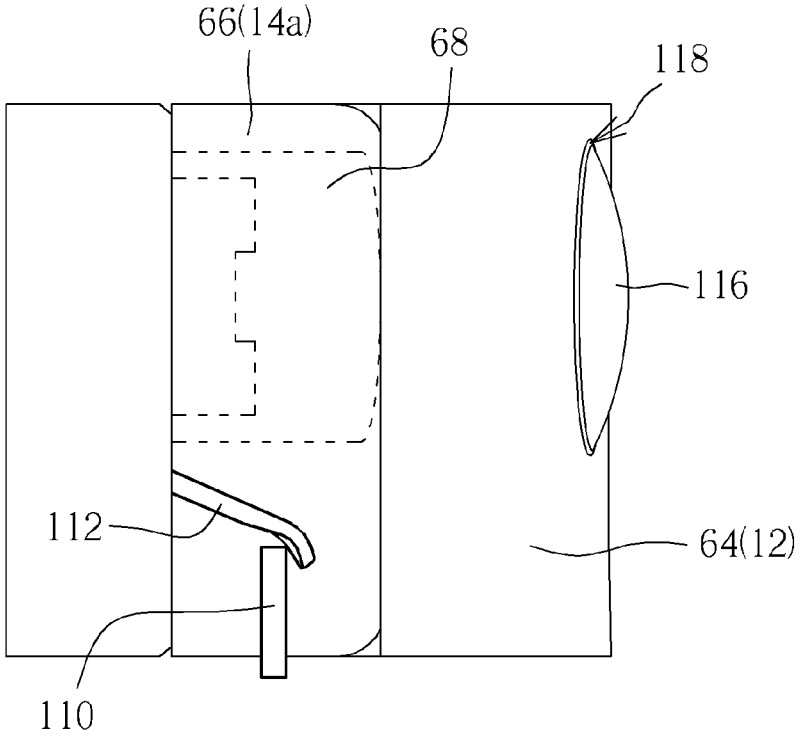
FIG. 18 to FIG. 20 respectively are diagrams of the toddler seat and the frame in different modes according to the first embodiment of the present invention.
Figure 19:
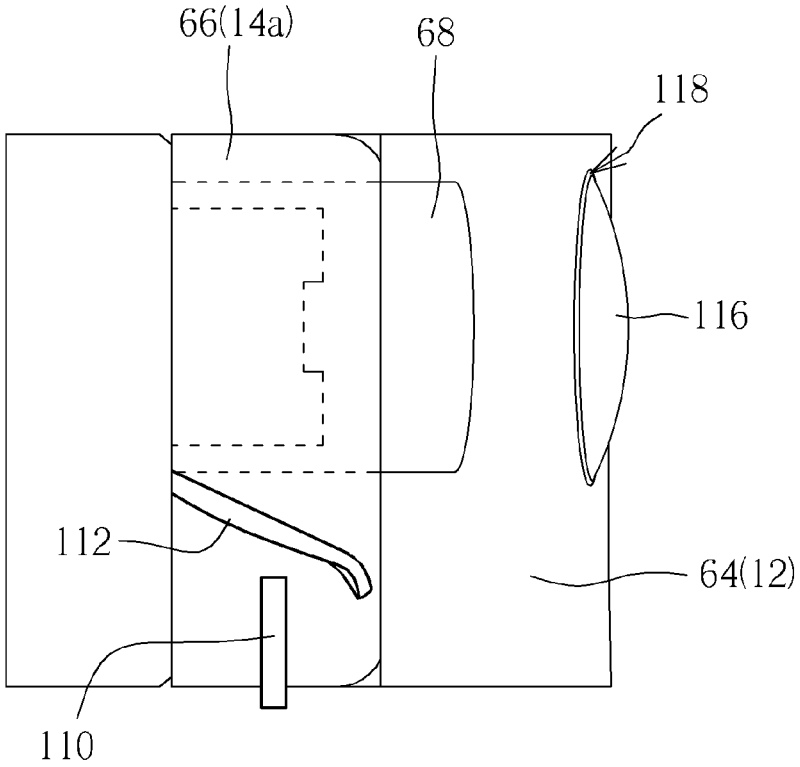
Figure 20:
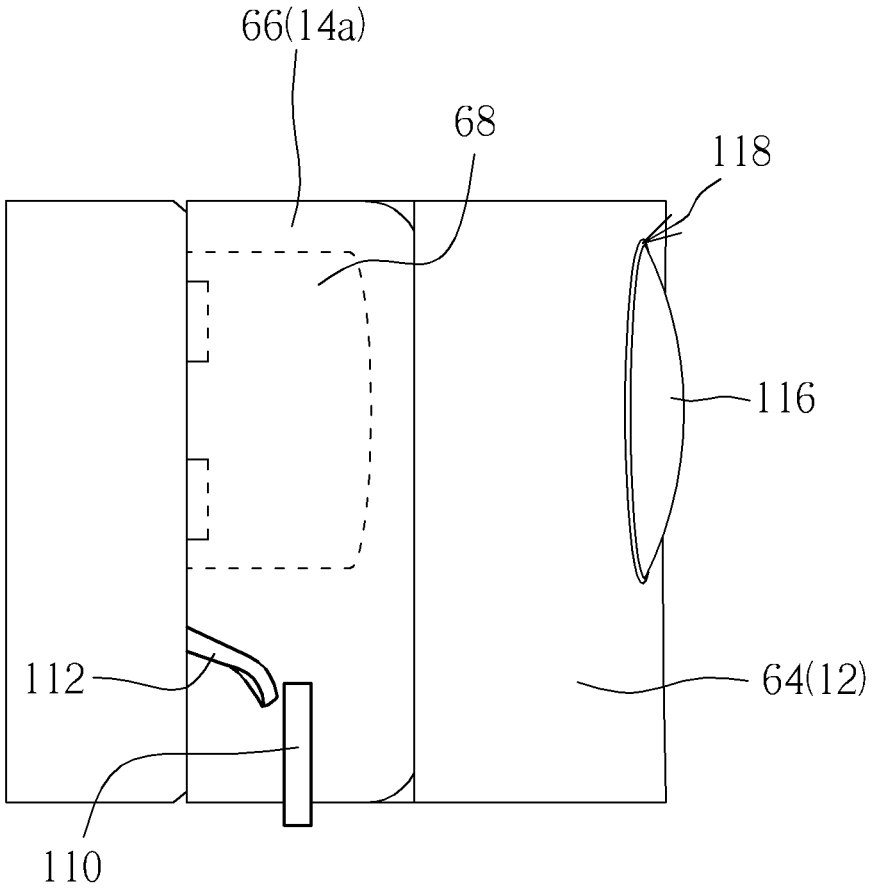
Figure 21:
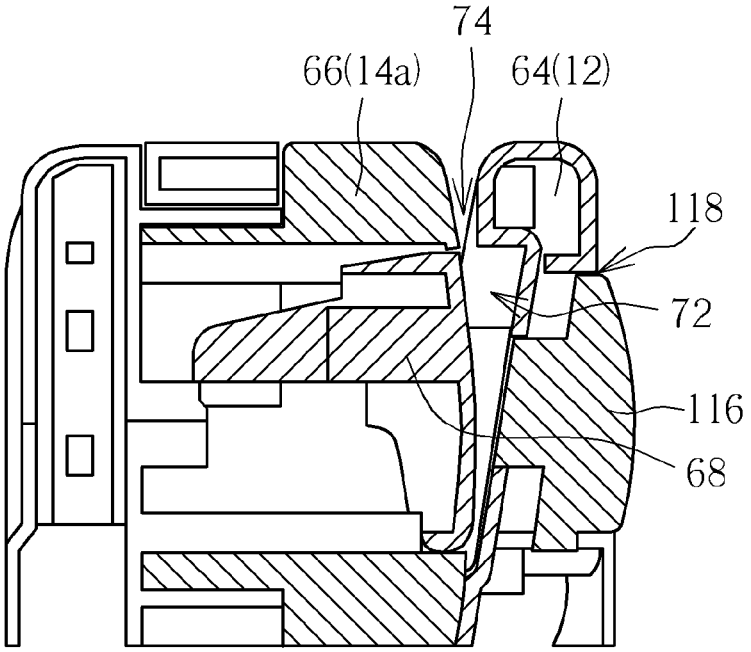
FIG. 21 is a sectional view of the toddler seat and the frame shown in FIG. 18.
Figure 22:
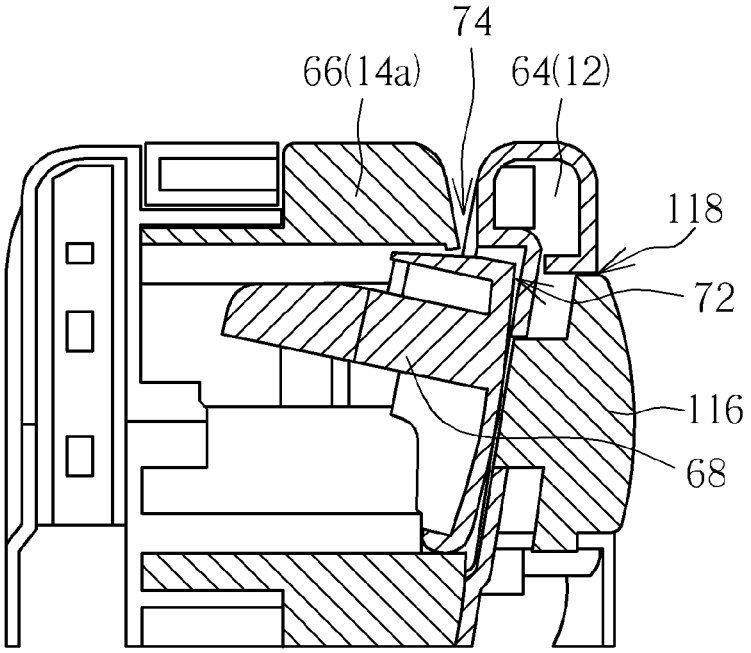
FIG. 22 is a sectional view of the toddler seat and the frame shown in FIG. 19.
Figure 23:
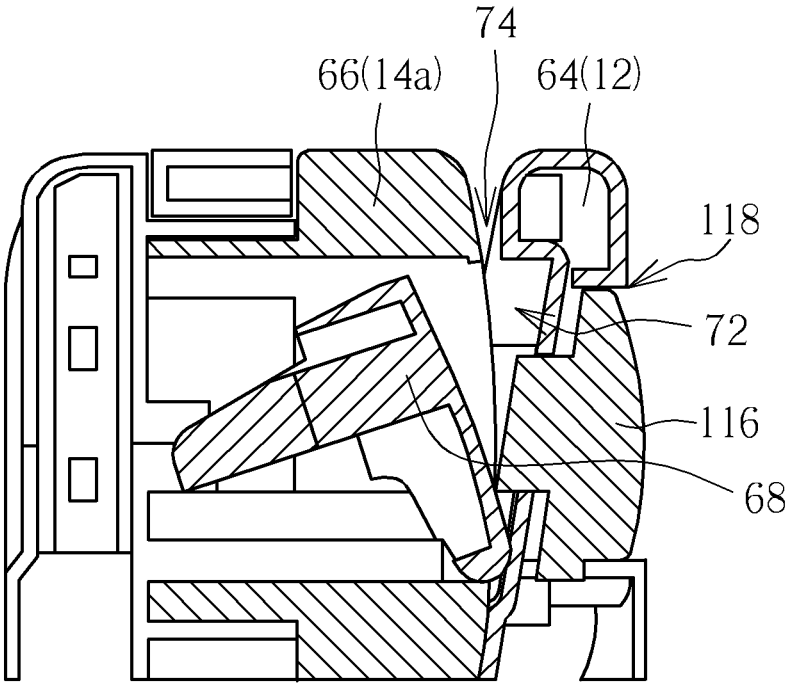
FIG. 23 is a sectional view of the toddler seat and the frame shown in FIG. 20.

Please refer to FIG. 16 to FIG. 23. FIG. 18 to FIG. 20 respectively are diagrams of the toddler seat 14*a* and the frame 12 in different modes according to the first embodiment of the present invention. FIG. 21 is a sectional view of the toddler seat 14*a* and the frame 12 shown in FIG. 18. FIG. 22 is a sectional view of the toddler seat 14*a* and the frame 12 shown in FIG. 19. FIG. 23 is a sectional view of the toddler seat 14*a* and the frame 12 shown in FIG. 20. A button 116 is movably disposed on a hole 118 formed on the first combining component 64. As shown in FIG. 18 and FIG. 21, the latch 68 is rotated by pressure of the first combining component 64 since the toddler seat 14*a* is placed on the frame 12 and the retaining slot 108 is engaged with the retaining portion 110. The latch 68 can inwardly rotate relative to the first combining component 64 to move into the opening 74. In the meantime, the free end of the finger 112 contacts against the retaining portion 110.

As shown in FIG. 19 and FIG. 22, the latch 68 outwardly rotates to protrude from the opening 74 to engage with the sunken portion 72 since the toddler seat 14*a* is accurately assembled with the frame 12, and the finger 112 slidably contacts the retaining portion 110. The free end of the finger 112 is still located to a right side of the retaining portion 110. As shown in FIG. 20 and FIG. 23, the user intends to disengage the toddler seat 14*a* from the frame 12, the button is fully depressed to push the latch 68 out of the sunken portion 72 and the latch 68 is retracted into the opening 74; meanwhile, the free end of the finger 112 moves from the foresaid right side to a left side of the retaining portion 110, and contacts against a left surface of the of the retaining portion 110. Rotation of the latch 68 is constrained and the latch 68 cannot protrude from the opening 74. Thus, the toddler seat 14*a* can be easily lifted off from the frame 12 without extra manual constraint of the latch 68. When the toddler seat 14*a* is spaced from the frame 12, the finger 112 does not contact the retaining portion 110, so that the compressive spring can drive the latch 68 to protrude from the opening 74 once again.

Figure 24:
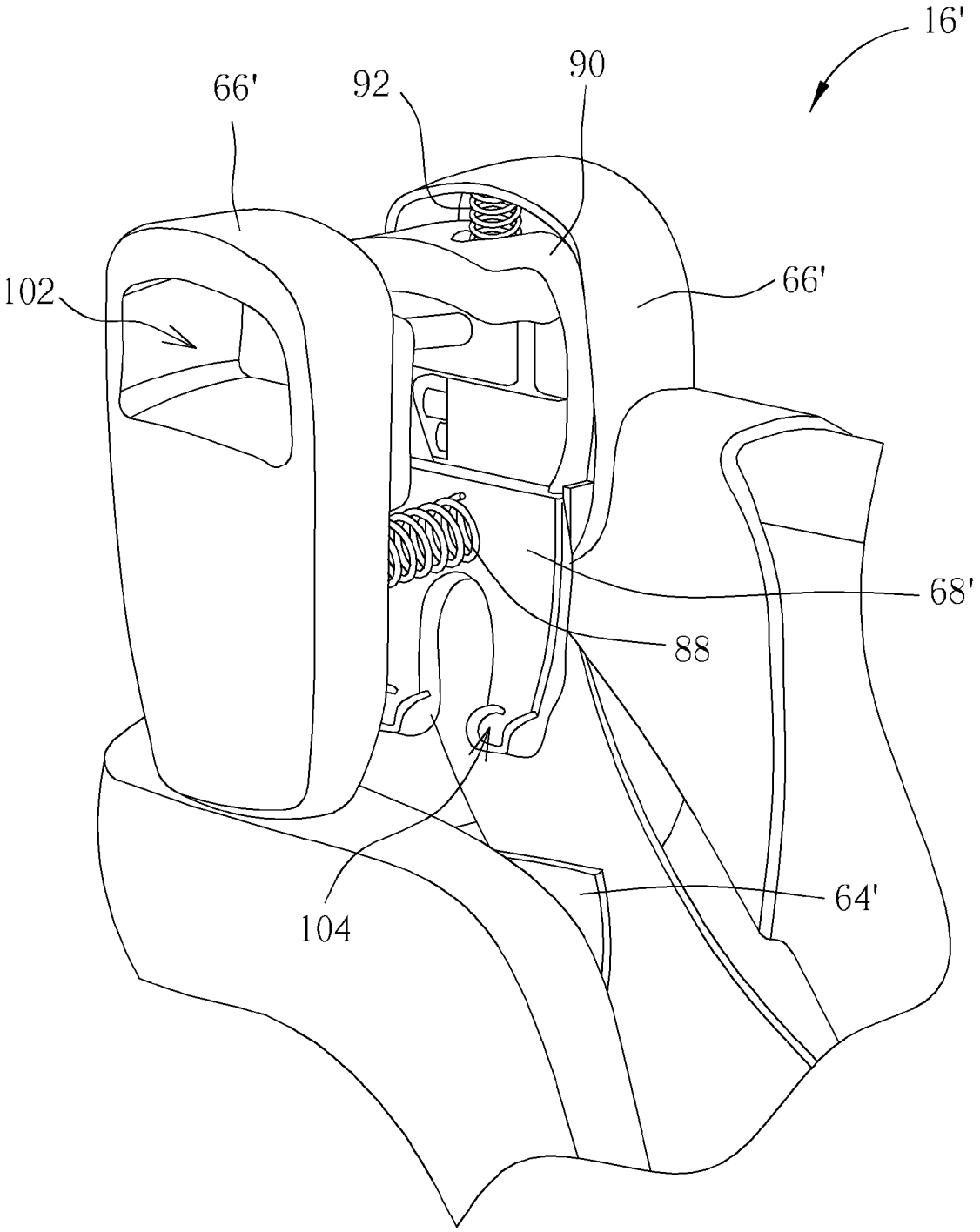
FIG. 24 is an exploded diagram of the seat attaching mechanism according to a second embodiment of the present invention.
Figure 25:
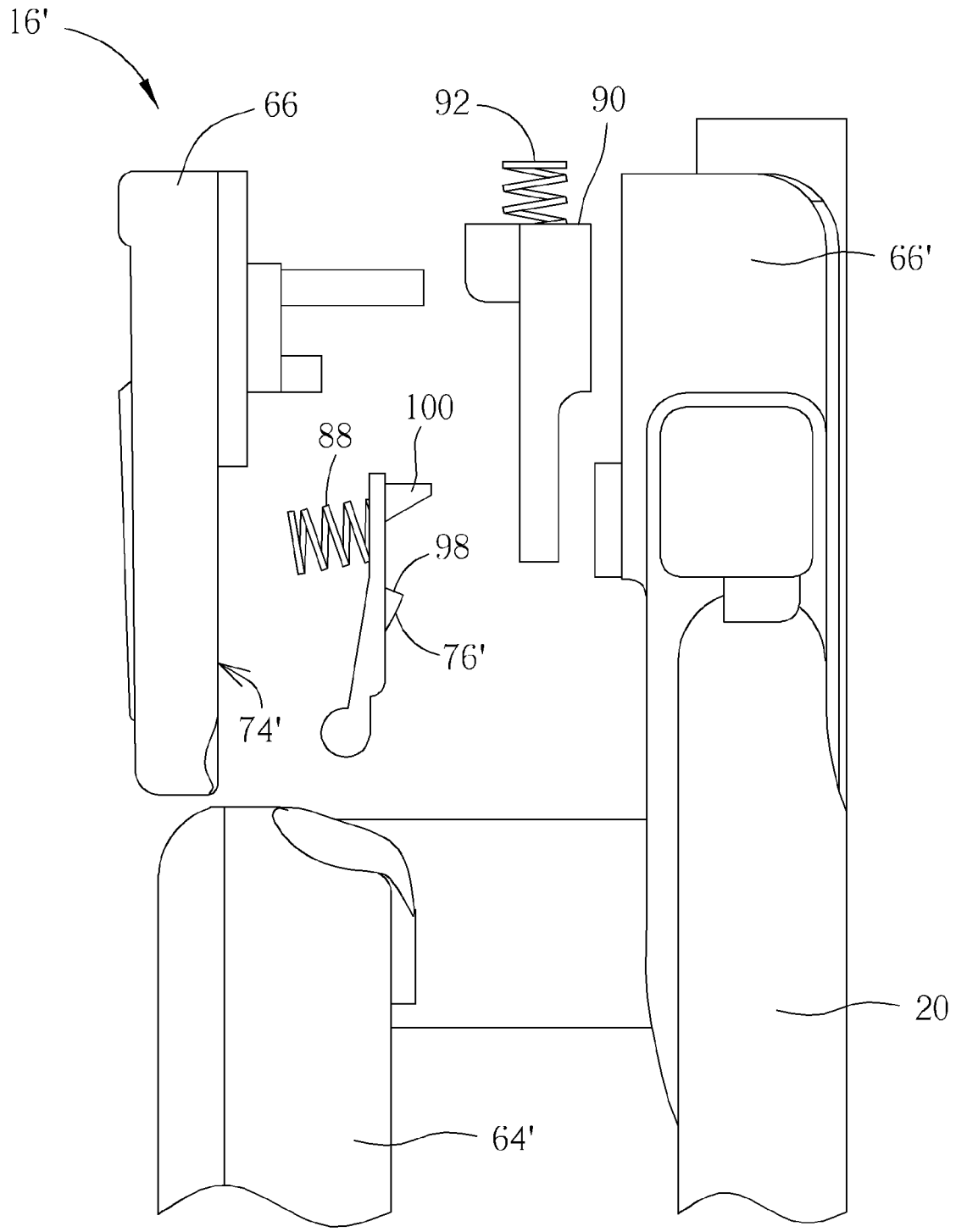
FIG. 25 is another view of the seat attaching mechanism shown in FIG. 24.
Figure 26:
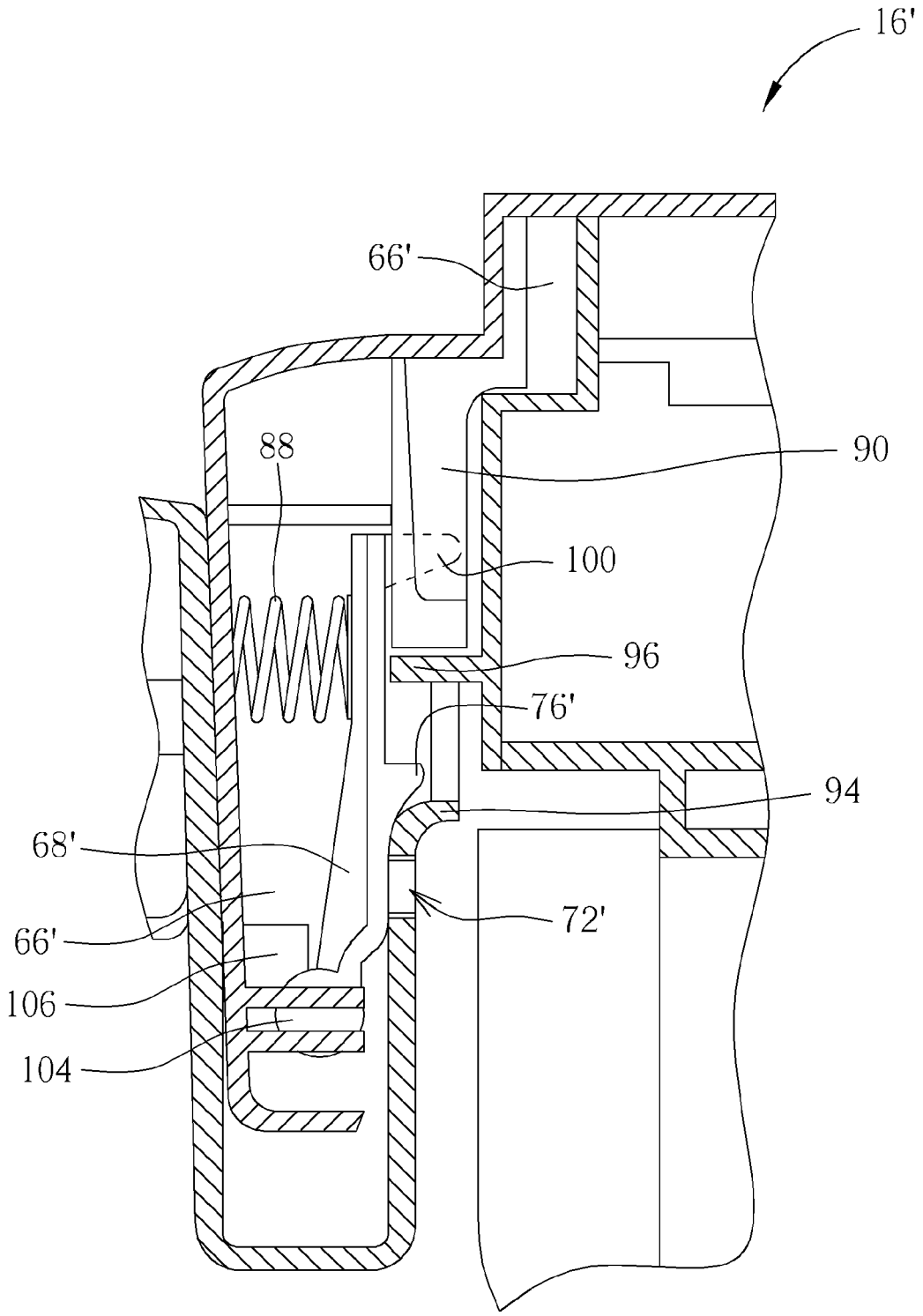
FIG. 26 to FIG. 28 respectively are sectional views of the seat attaching mechanism in different modes according to the second embodiment of the present invention.
Figure 27:
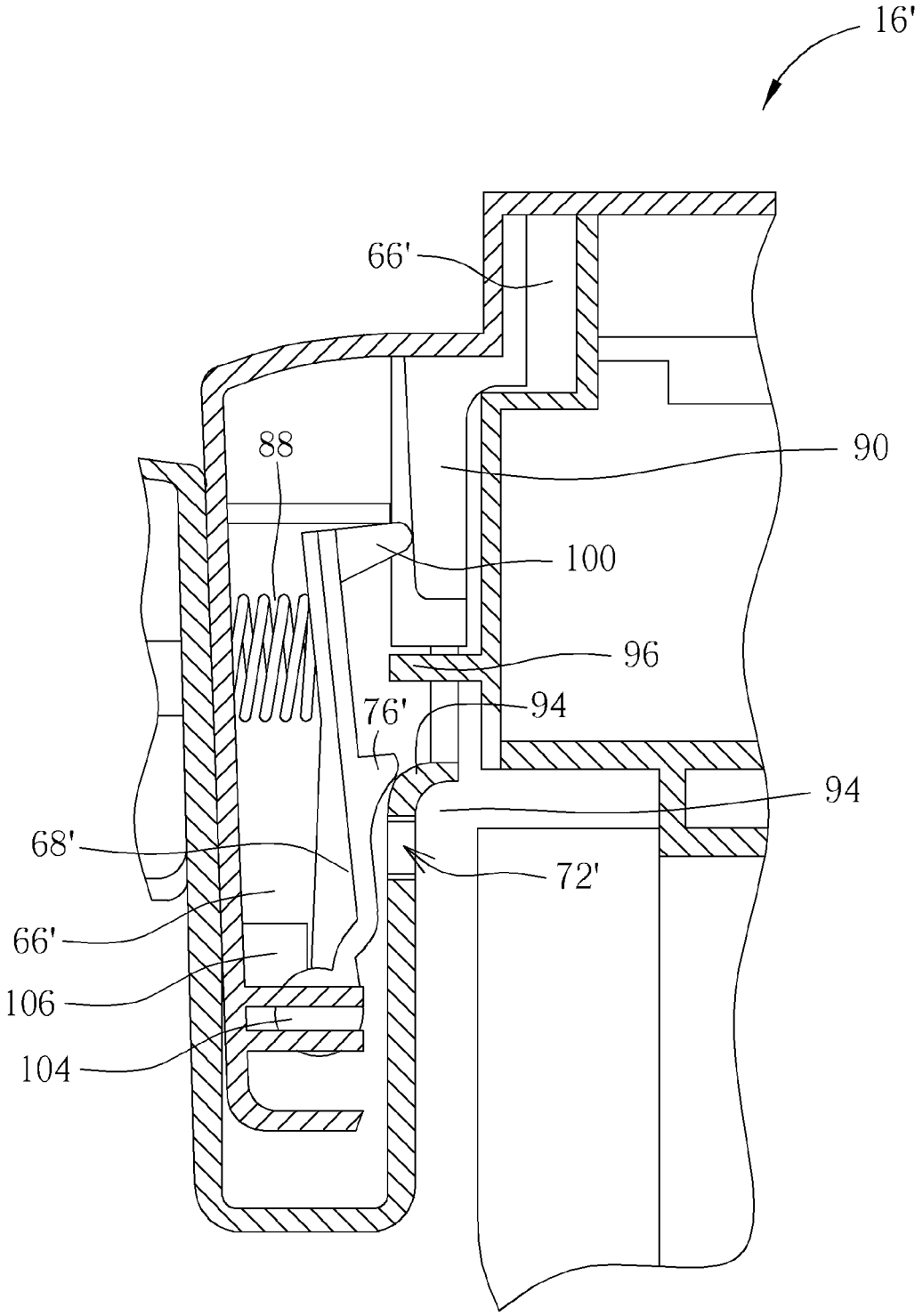
Figure 28:
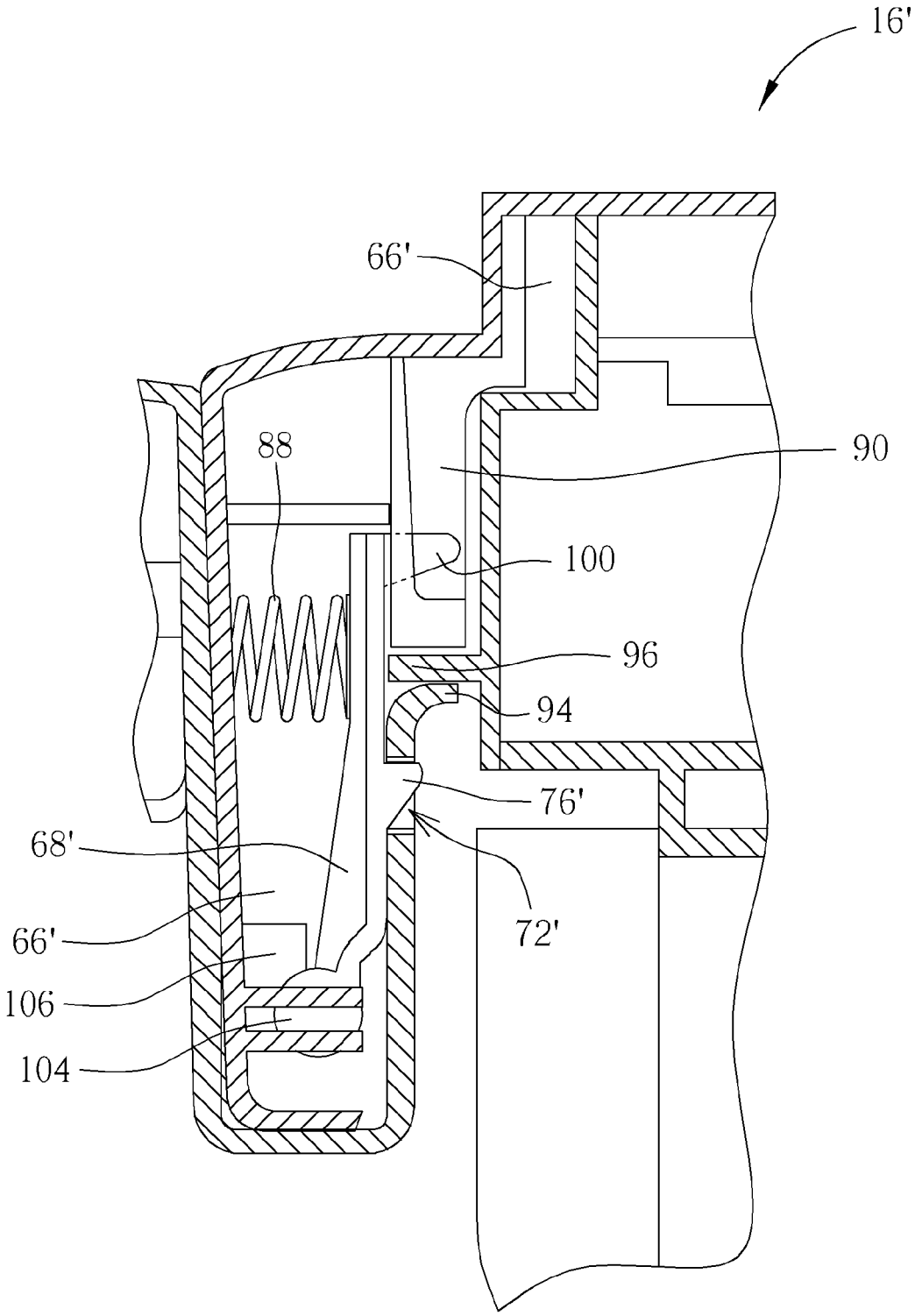
Figure 29:
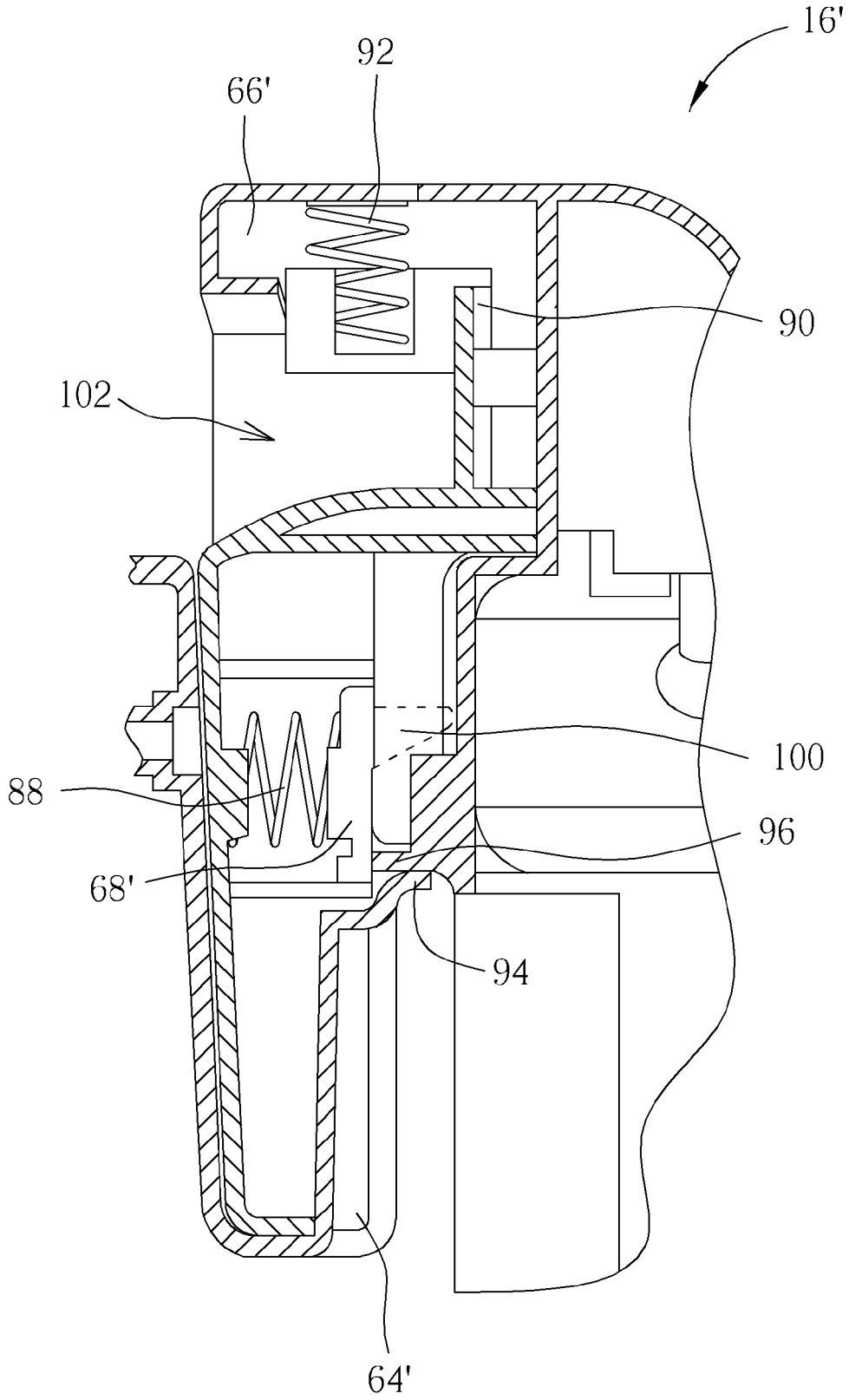
FIG. 29 and FIG. 30 respectively are other sectional views of the seat attaching mechanism in different modes according to the second embodiment of the present invention.
Figure 30:
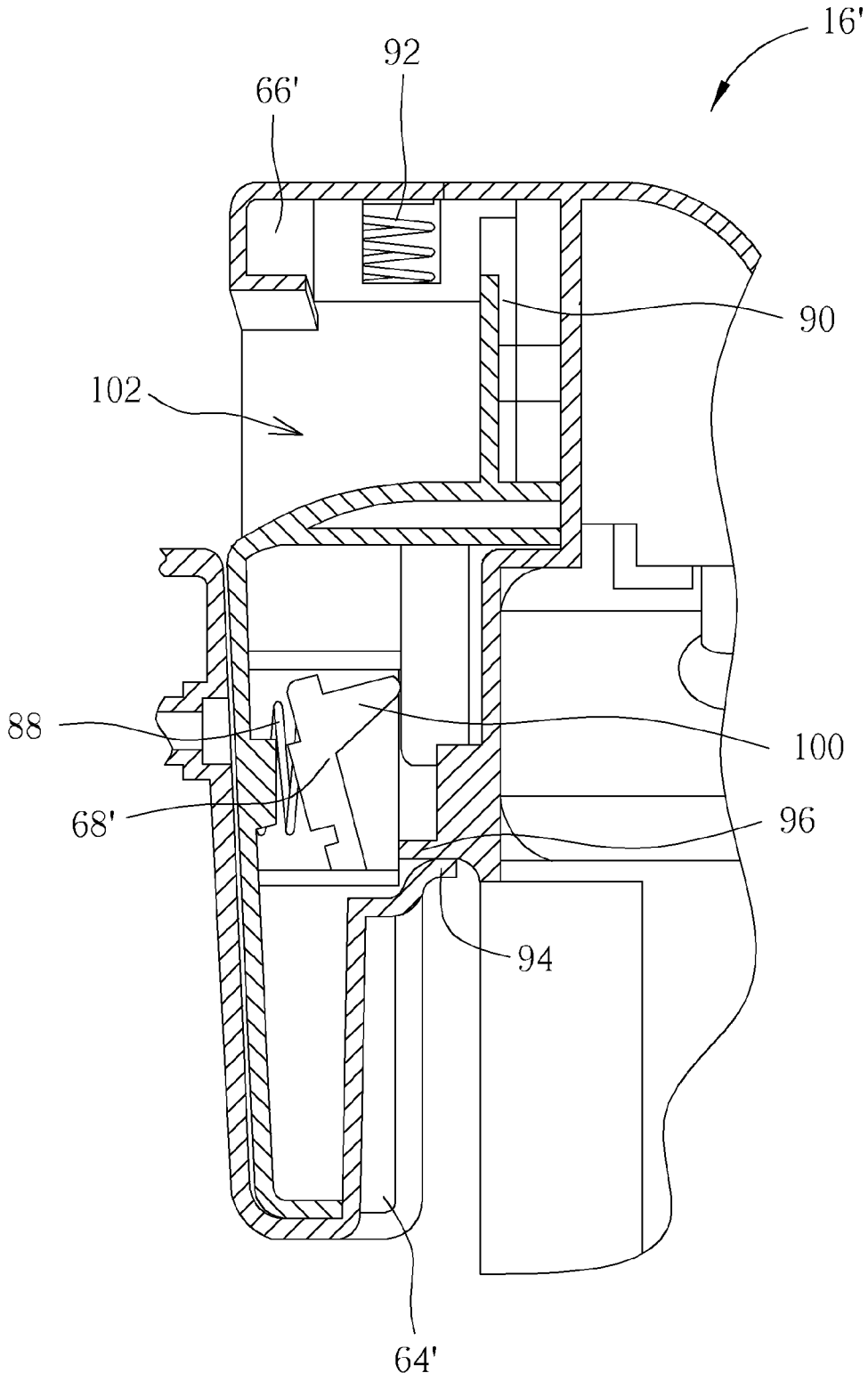

Please refer to FIG. 24 to FIG. 30. FIG. 24 is an exploded diagram of the seat attaching mechanism 16' according to a second embodiment of the present invention. FIG. 25 is another view of the seat attaching mechanism 16' shown in FIG. 24. FIG. 26 to FIG. 28 respectively are sectional views of the seat attaching mechanism 16' indifferent modes according to the second embodiment of the present invention. FIG. 29 and FIG. 30 respectively are other sectional views of the seat attaching mechanism 16' in different modes according to the second embodiment of the present invention. The seat attaching mechanism 16' of the second embodiment can be applied to the infant seat 14*b* and the toddler seat 14*a* for stable constraint of the seat to the frame.

The seat attaching mechanism 16' includes the first combining component 64', the second combining component 66', the latch 68', a flexible component 88, an actuating component 90 and a resilient component 92. The first combining component 64' can be a pocket whereinto the second combining component 66' inserts. A shape of the first combining component 64' conforms to a shape of the second combining component 66', which means outer walls of the second combining component 66' contact against inner walls of the first combining component 64', to stably constrain combination of the first combining component 64' and the second combining component 66' and to laterally secure the seat body 20. Further, an upper wall 94 of the first combining component 64' contacts against a wall 96 of the seat body 20, so as to vertically secure the seat body 20.

An end (such as the low end) of the latch 68' pivots to the second combining component 66'. The protruding portion 76' is disposed on middle of the latch 68', and a guiding structure 98 is disposed on the protruding portion 76' to slidably contact the upper wall 94 of the first combining component 64'. Relative slide of the guiding structure 98 and the first combining component 64' moves the protruding portion 76' into the opening 74' during combination of the second combining component 66' and the first combining component 64', as shown in FIG. 26 and FIG. 27. The latch 68' further includes an inclined protrusion 100 adjacent to the protruding portion 76'. Two ends of the flexible component 88 are respectively connected to the latch 68' and the second combining component 66'. The protruding portion 76' is engaged with the sunken portion 72' and the inclined protrusion 100 is engaged with the actuating component 90 by flexible recovering force of the flexible component 88, as shown in FIG. 28.

The actuating component 90 is movably disposed on the second combining component 66' and slidably contacts the inclined protrusion 100. A part of the actuating component 90 is exposed via a control hole 102 formed on the second combining component 66', and two ends of the resilient component 92 are respectively connected to the actuating component 90 and the second combining component 66', as shown in FIG. 24. For disassembly of the first combining component 64' and the second combining component 66', an external force is upwardly applied to the actuating component 90 via the control hole 102, relative slide of the actuating component 90 and the inclined protrusion 100 can disengage the protruding portion 76' from the sunken portion 72', and the second combining component 66' is able to be detached from the first combining component 64' without constraint. The resilient component 92 moves the actuating component 90 to an initial position since external force is removed, and the protruding portion 76' is recovered to the position protruding from the opening 74' by the flexible component 88, as shown in FIG. 29 and FIG. 30.

A first wedging portion 104 is disposed on the end of the latch 68', a second wedging portion 106 is disposed on a bottom of the second combining component 66'. The first wedging portion 104 and the second wedging portion 106 respectively can be a slot and a rib, and a length of the slot is greater than a length of the rib. The first wedging portion 104 is slidably engaged with the second wedging portion 106 to provide rotary slide of the latch 68' relative to the second combining component 66', so as to ensure that the protruding portion 76' can be accurately engaged with the sunken portion 72' during rotation of the latch 68'. The low end of the latch 68' can pivot to the second combining component 66' by a screw, a pin or related features.

Comparing to the prior art, the present invention provides the child high chair with detached assembly of the frame and the seat. The seat can be the toddler seat or the infant seat. The toddler seat can be assembled with the frame or disassembled from the frame for being the standalone toddler chair. The infant seat can be assembled with the frame or disassembled from the frame for being the standalone infant rocker. The height position of the seat is adjusted relative to the frame by the height adjusting mechanism, which has advantages of simple structure and easy one-hand operation. The seat attaching mechanism utilizes the latch to detachably engage with the sunken portion for assembly of the combining components, which are respectively disposed on the frame and the seat, and gives consideration to stable assembly strength and preferred operational efficiency.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A child high chair, comprising
- a frame;
- a seat detachably assembled with the frame, the seat comprising a seat body; and
- a seat attaching mechanism disposed between the frame and the seat, the seat attaching mechanism comprising:
  - a first combining component disposed on the frame, a sunken portion being disposed inside the first combining component;
  - a second combining component disposed on the seat body and being adapted to combine with the first combining component, an opening being formed on the second combining component;
  - a latch disposed inside the second combining component, an end of the latch pivoting to the second combining component in a resilient recovery manner, the latch comprising a protruding portion, the protruding portion being adapted to protrude from the second combining component via the opening to detachably engage with the sunken portion, the latch further comprising an inclined protrusion adjacent to the protruding portion; and
  - an actuating component movably disposed on the second combining component, the actuating component slidably contacting the inclined protrusion to disengage the protruding portion from the sunken portion.

2. The child high chair of claim 1, wherein the seat attaching mechanism further comprises a releasing component movably disposed on the seat body and connected to the latch.

3. The child high chair of claim 2, wherein the releasing component rotates the latch relative to the second combining component to retract the protruding portion into the opening since the releasing component is pressed relative to the seat body.

4. The child high chair of claim 2, wherein the latch further comprises a stretching portion disposed on the other end of the latch, the releasing component has a first side and a second side opposite to each other, the first side pivots to the seat body, and the second side is connected to the stretching portion of the latch.

5. The child high chair of claim 1, wherein the first combining component comprises a first engaging portion adjacent to a lower side of the sunken portion, a second engaging portion is disposed on a bottom of the second combining component, and the second engaging portion is engaged with the first engaging portion since the second combining component is combined with the first combining component.

6. The child high chair of claim 1, wherein the latch further comprises a guiding structure disposed on the protruding portion, the guiding structure slidably contacts the first combining component to move the protruding portion into the opening.

7. The child high chair of claim 1, wherein the seat attaching mechanism further comprises a flexible component, two ends of the flexible component are respectively connected to the latch and the second combining component.

8. The child high chair of claim 1, wherein a part of the actuating component is exposed via a control hole formed on the second combining component.

9. The child high chair of claim 1, wherein the seat attaching mechanism further comprises a resilient component, two ends of the resilient component are respectively connected to the actuating component and the second combining component.

10. The child high chair of claim 1, wherein a first wedging portion is disposed on the end of the latch, a second wedging portion is disposed on a bottom of the second combining component, and the first wedging portion is engaged with the second wedging portion since the latch pivots to the second combining component.

11. The child high chair of claim 1, wherein the frame further comprises a low supporter and an upper supporter slidably disposed on the low supporter, and the child high chair further comprises a height adjusting mechanism disposed on the frame, the height adjusting mechanism comprises:

a base;

at least one hook rotatably disposed inside the upper supporter and being adapted to simultaneously insert into piercing holes formed on the upper supporter and the low supporter;

a triggering component movably disposed on the base; and at least one cable, two ends of the cable being respectively connected to the hook and the triggering component, wherein the triggering component moves relative to the base to rotate the hook via the cable.

12. The child high chair of claim 11, wherein the height adjusting mechanism further comprises at least one pulling component rotatably disposed on the base, a first rod of the pulling component is connected to the cable and movably contacts against the triggering component, a second rod of the pulling component slidably contacts the cable.

13. The child high chair of claim 12, wherein an angle is formed between the first rod and the second rod.

14. The child high chair of claim 11, wherein the height adjusting mechanism further comprises an elastic component, elastic recovering force of the elastic component drives the hook to insert into the piercing holes of the upper supporter and the low supporter.

15. The child high chair of claim 14, wherein the height adjusting mechanism further comprises a holding component slidably disposed inside the upper supporter, a pin of the hook slidably inserts into a chute of the holding component, and the elastic component is connected between the holding component and the upper supporter.

16. The child high chair of claim 1, wherein the first combining component further comprises a retaining portion disposed on an inner surface of the first combining component, a retaining slot is formed on the second combining component, the first combining component is engaged with the second combining component by assembly of the retaining portion and the retaining slot.

17. The child high chair of claim 16, wherein a finger of the latch slidably contacts the retaining portion, the finger contacts against a surface of the retaining portion to constrain relative movement between the latch and the second combining component and the latch is located inside the opening.

* * * * *